US010862183B2

(12) United States Patent
Numssen et al.

(10) Patent No.: US 10,862,183 B2
(45) Date of Patent: Dec. 8, 2020

(54) MICROWAVE BANDPASS FILTER COMPRISING A CONDUCTIVE HOUSING WITH A DIELECTRIC RESONATOR THEREIN AND INCLUDING AN INTERNAL COUPLING ELEMENT PROVIDING COUPLING BETWEEN HEEX AND HEEY MODES

(71) Applicant: SPINNER GmbH, Munich (DE)

(72) Inventors: Kai Numssen, Frankfurt (DE); Jörn Pfeifer, Munich (DE); Martin Lorenz, Kempten (DE); Christian Orlob, Tuntenhausen (DE); Christoph Neumaier, Baiern (DE); Natalie Spaeth, Rosenheim (DE)

(73) Assignee: Spinner GmbH

( * ) Notice: Subject to any disclaimer, the term of this patent is extended or adjusted under 35 U.S.C. 154(b) by 54 days.

(21) Appl. No.: 15/922,472

(22) Filed: Mar. 15, 2018

(65) Prior Publication Data

US 2018/0212299 A1 Jul. 26, 2018

Related U.S. Application Data

(63) Continuation of application No. PCT/EP2016/071864, filed on Sep. 15, 2016.

(30) Foreign Application Priority Data

Sep. 15, 2015 (EP) ..... 15185296

(51) Int. Cl.
*H01P 1/208* (2006.01)
*H01P 7/10* (2006.01)

(52) U.S. Cl.
CPC ..... *H01P 1/2086* (2013.01); *H01P 1/2084* (2013.01); *H01P 7/10* (2013.01); *H01P 7/105* (2013.01)

(58) Field of Classification Search
CPC ..... H01P 1/2084; H01P 7/10; H01P 7/105; H01P 1/2086

(Continued)

(56) References Cited

U.S. PATENT DOCUMENTS 5,200,721 A 4/1993 Mansour
5,515,016 A * 5/1996 Holme et al. ..... H01P 1/2084 333/202

(Continued)

FOREIGN PATENT DOCUMENTS

EP 0104735 A2 8/1983
EP 0123448 A1 3/1984

(Continued)

OTHER PUBLICATIONS

Office Action dated Apr. 2, 2019, issued in related Chinese Patent Application No. 201680053461.2, 7 pages.

*Primary Examiner* — Benny T Lee
(74) *Attorney, Agent, or Firm* — Yakov S. Sidorin; Quarles & Brady LLP

(57) ABSTRACT

A quad-mode microwave or RF bandpass filter comprises a housing of a conductive material defining a cylindrical cavity and containing a cylindrical dielectric resonator defined by a parallel pair of face surfaces. The dielectric resonator is held within the housing between a pair of support plates of a dielectric material. Internal coupling elements are provided above and/or below the dielectric resonator for coupling between resonating modes. Further mode coupling elements are protruding into the housing.

18 Claims, 20 Drawing Sheets

(58) Field of Classification Search
USPC ..... 333/202, 219.1, 235
See application file for complete search history.

(56) References Cited

U.S. PATENT DOCUMENTS

| | | | | |
|---|---|---|---|---|
| 6,255,919 | B1 * | 7/2001 | Smith | H01P 1/2084 333/202 |
| 6,522,225 | B2 * | 2/2003 | Liang et al. | H01P 1/2084 333/202 |
| 8,847,709 | B2 * | 9/2014 | Tiihonen | H01P 1/2084 333/202 |
| 2002/0149449 | A1 | 10/2002 | Mansour et al. | |
| 2003/0151473 | A1 * | 8/2003 | Accatino et al. | H01P 7/10 333/202 |
| 2007/0115080 | A1 * | 5/2007 | Pance et al. | H01P 1/2084 333/202 |

FOREIGN PATENT DOCUMENTS

| | | | |
|---|---|---|---|
| EP | 0188367 | A2 | 7/1986 |
| EP | 0328948 | A1 | 8/1989 |
| EP | 0351840 | A2 | 1/1990 |
| EP | 0477925 | A1 | 4/1992 |
| EP | 1220351 | A2 | 7/2002 |
| EP | 2151885 | A2 | 2/2010 |
| JP | 2000049513 | A | 2/2000 |
| WO | 0209228 | A1 | 1/2002 |

* cited by examiner

MICROWAVE BANDPASS FILTER COMPRISING A CONDUCTIVE HOUSING WITH A DIELECTRIC RESONATOR THEREIN AND INCLUDING AN INTERNAL COUPLING ELEMENT PROVIDING COUPLING BETWEEN HEEX AND HEEY MODES

CROSS-REFERENCE TO RELATED APPLICATIONS

This application is a continuation of pending International Application No. PCT/EP2016/071864 filed on Sep. 15, 2016, which designates the United States and claims priority from European Application No. 15185296.9 filed on Sep. 15, 2015. The disclosure of each of the above-identified applications is incorporated by reference herein.

BACKGROUND

1. Field of the Invention

The invention relates to microwave or RF filters, and more particularly to filters having at least one dielectric resonator. Preferably, the dielectric resonator has a cylindrical outer contour. Most preferably, the dielectric resonator comprises at least two cylindrical components.

2. Description of Relevant Art

Microwave or RF filters, more specifically microwave bandpass filters are commonly used in communication systems. Mostly, such filters are based on conventional rectangular and circular waveguide resonators. There is continuous need to decrease the size and volume of these filters. This may be done by using filters based on dielectric resonators. Typically, such a dielectric resonator comprises a high dielectric constant material, which preferably is in a cylindrical form. The resonator is mounted inside a metal enclosure. The electromagnetic field is concentrated mainly in the dielectric cylinder. Therefore, the Q-factor of the resonator is determined largely by the loss tangent of the dielectric material of the resonator.

U.S. Pat. No. 5,200,721 discloses a dual-mode filter having a dielectric resonator in two separated cavities. The cylindrical resonators are designed such that at least one cavity resonates in a dual HEH11 mode, whereas a spurious HE11 mode is shifted to a higher frequency.

A quasi-dual-mode resonator is disclosed in US 2002/0149449 A1. It comprises a resonator being a half disk.

Dielectric resonator filters using a disk operating in a HEH11 dual-mode and an HEE11 dual-mode are disclosed in EP 2 151 885 B1. The resonator is mounted on a solid mounting support formed from a unitary piece of low permittivity dielectric substrate.

SUMMARY OF THE INVENTION

The embodiments are based on the object of providing microwave or RF filters with a comparatively large bandwidth and low pass-through attenuation while maintaining steep slopes. The filter should be compact and robust. It should be adjustable with a high degree of flexibility.

In an embodiment, a microwave or RF bandpass filter comprises at least one dielectric resonator held in a conductive housing, forming a cavity. The at least one dielectric resonator has an outer contour of a cylindrical shape defined by a parallel pair of face surfaces, each face surface having at least two symmetry axes. Preferably, the dielectric resonator has an outer contour which is most preferably defined by a parallel pair of at least approximately face surfaces having the same size or diameter.

In a related embodiment, the dielectric resonator has a cylindrical shape defined by a parallel pair of approximately square, octagonal, or similarly shaped face surfaces. In the case of a non-circular resonator, the diameter is defined as the mean lateral dimension. In a first embodiment, the face surfaces are circular and preferably have the same diameter. The cylinder may have an inner hole or bore.

In another embodiment, there are at least two approximately cylindrical dielectric components within the outer cylindrical contour. Such a dielectric resonator may comprise two cylindrical outer sections and at least one preferably cylindrical inner section between the outer sections. The inner section may be smaller or have a smaller diameter than the outer sections. There may be coupling elements preferably of a dielectric material which preferably are evenly angular spaced around the center axis. They are preferably movable in axial directions as indicated by direction indicators. The coupling elements are preferably arranged such that they intersect a common plane with the at least inner section and most preferably are designed to intrude into the space between the outer sections. Furthermore, at least one spacer between the resonator sections may be provided for holding the resonator within the cavity. Using thin strips as spacer may provide enough space for the previously mentioned coupling elements. There may be any number of spacers. There may be multiple separated spacer sections. Also, the spacer sections or spacers may be combined to a single piece spacer. In this embodiment, the support plates are no longer required.

In yet another embodiment, the dielectric resonator may also have a cuboidal shape.

The dielectric resonator may have a center axis defined by the centers of the face surfaces. Preferably, the dielectric resonator comprises a dielectric material, most preferably having low dielectric losses and a high dielectric constant. This material may be a ceramic material. Furthermore, the resonator may comprise only dielectric material and no electrically conductive material. There may also be a plastic material.

The housing comprises an electrically conductive material, preferably a metal. The inner surface of the housing may comprise or may be coated with a high conductive and preferably corrosion-resistant material, like silver, gold, or an alloy thereof. The housing may form a cylindrical cavity defined by a parallel pair of inner face surfaces having the same diameter. The housing may have a center axis which may be defined by the center points of the parallel face surfaces. The housing may also have a cuboidal shape. It may further have a cylindrical shape defined by a parallel pair of approximately square, octagonal, or similarly shaped surfaces. A center axis may be defined by the center of the parallel face surfaces. Preferably, the housing has a cover, which may be removable.

The dielectric resonator is held within the cavity by means of at least one support plate. Preferably, there are two support plates, each at one of the face surfaces of the dielectric resonator. The support plates may enclose the dielectric resonator like a sandwich. The support plates may have a contour which interfaces with the housing. At least one of the support plates may be rectangular, squared, circular or adapted to the inner contour of the housing. At least one of the support plates may interface with at least one groove or protrusion in the housing.

The material of the support plates preferably is a material having a low or medium dielectric constant. The relative dielectric constant is preferably in a range between 2 and 11.0 and most preferably in a range between 8.5 and 11.0. The support plate may comprise PTFE, a plastic or a ceramic material. The thickness of the support plates is significantly less than the height of the dielectric resonator. Preferably it is less than 1/10 of the height of the dielectric resonator. Therefore and by the fact that the dielectric constant of the support plates is comparatively lower than the dielectric constant of the dielectric resonator, the influence of the support plates to the dielectric resonator is comparatively low, or even negligible.

As known from related art, ceramic resonators are held in a cavity by a solid support rod or cylinder. This support rod does not allow to access both sides of the cylinder symmetrically. Due to the support plates, coupling elements for coupling energy between different modes can be mounted at both sides of the dielectric resonator. This enables to build a quad-mode filter with one dielectric resonator as a comparatively small unit. It furthermore allows to build a largely adjustable filter, as different adjustable coupling and tuning elements can be mounted under or over the dielectric resonator.

The filter has four resonating modes. The first mode is a HEHx mode having a first resonance frequency. The second mode is a HEEx mode having a second frequency. The third mode is a HEEy mode having a third frequency. The fourth mode is a HEHy mode having a fourth frequency. This applies preferably to a circular cylinder dielectric resonator. There may be further modes. Reference is made to the book "Microwave filters for Communication Systems" by Richard J. Cameron et al., Wiley Intersciences, 2007, pages 567-583. Specifically on page 575, the electric field distributions of the HEH and the HEE modes are shown.

In the following, it is assumed that the center axis of the dielectric resonator is the same or approximately the same as the center axis of the cavity. Furthermore, there is a first orthogonal plane defined by the center axis of the dielectric resonator and the location of a first external coupling element, which will be used for connecting a signal source. There is a second orthogonal plane which is also defined by the center axis of the dielectric resonator and which is under a 90 degrees angle to the first orthogonal plane. A second external coupling element which may be connected to a load is mounted in that second orthogonal plane. To simplify the reference to the modes, an orthogonal coordinate system is introduced. It has an x-axis lying in the first orthogonal plane, pointing from the center axis of the dielectric resonator to the first external coupling element, a y-axis from the center axis of the dielectric resonator pointing towards the second external coupling element, and a z-axis pointing along the center axis of the dielectric resonator in a direction to the bottom as used herein.

The dielectric resonator height and the dielectric resonator diameter are selected such that the degenerate HEH and HEE modes resonates at a common resonance frequency. Preferably, the ratio of dielectric resonator diameter to dielectric resonator height is in the range of 0.9 to 3.1. Preferably, the range is between 1.7 and 2.3. According to another embodiment, the range may be between 1.8 and 2.0. In specific cases a ratio of up to 7 may be used.

The filter has an input which may be connected to a signal source, and an output which may be connected to a load. There may be a first external coupling element for feeding electrical energy which may be delivered by the source into the filter, and for exiting the HEHx mode with a main electrical field component in the first orthogonal plane in xdirection.

For coupling energy from the HEHx mode to other modes, coupling elements are provided. There may be at least one second internal coupling element which preferably comprises an electrically conductive material or a dielectric material with a preferably high dielectric constant in the vicinity of the dielectric resonator, without touching the dielectric resonator, preferably under a 45 degrees angle to the first orthogonal plane and most preferably in a height between the first face surface and the second face surface of the dielectric resonator. This second internal coupling element will transfer energy from the first mode which is a HEHx mode, to the fourth mode which is a HEHy mode, orthogonally to the HEHx mode with its main electrical field component in the second orthogonal plane in y-direction. The energy from this HEHy mode may be picked up with a second external coupling element orthogonal to the first external coupling element. Although it is sufficient to have only one second internal coupling element, there may be a plurality of such coupling elements, like 2, 3, 4 or more coupling elements, preferably oriented towards the first orthogonal plane under 45 degree angles.

Coupling (of energy) from the HEHx mode and the HEHy mode to a HEEx and a HEEy mode, of the resonator, is preferably achieved as a result of having the dielectric resonator displaced with respect to the center of the cavity. Therefore, the center in height of the dielectric resonator is offset to the center in height of the cylindrical cavity. Such a displacement may preferably be made by displacing the location of the support plates and/or by adjusting the thickness of the support plates and/or by an offset in at least one of the two inner face surfaces of the cavity. The displacement may be adjustable by adapting the inner contour, preferably of the height of the offset in the contour of the inner face surface of the cavity. Therefore, a set of different covers forming the inner face surfaces of the cavity may be provided, from which the best fitting cover resulting in a desired coupling may be selected for each filter. By the axial displacement of the dielectric resonator with respect to the cylindrical cavity, there is an energy transfer between the HEHx mode and the HEEx mode as well as between the HEHy mode and the HEEy mode. This coupling may further be adjusted by third internal coupling elements which are similar components as the second internal coupling element. The third internal coupling elements preferably are arranged in plane above the second support plate and/or below the first support plate. Most preferably, the third internal coupling elements are arranged symmetrical to the center axis. There may be 4 third internal coupling elements with relative angles of 90 degrees to each other or 3 third internal coupling elements with relative angles of 120 degrees to each other. In an alternative embodiment, a resonator comprising multiple stacked dielectric cylinders with different diameters may be provided to adjust coupling from the HEHx mode and the HEHy mode to a HEEx and a HEEy mode. A resonator may comprise at least two different sections, each section having an outer contour defined by a parallel pair of face surfaces. Each face surface may have at least two symmetry axes, and the dielectric resonator preferably has a center axis.

For coupling the HEEx mode to the HEEy mode, at least one first internal coupling element is provided. There may be two such internal coupling elements, which preferably are arranged symmetrical above and below the dielectric resonator. They may be rotated against each other about the dielectric resonator center axis at an angle of 90 degrees. They may have different distances to the upper and/or lower surface of the dielectric resonator. The at least one first coupling element preferably comprises at least one bar of electrically conductive or of dielectric material, which is located approximately parallel to the upper and/or lower face surface of the dielectric resonator. Preferably, the at least one bar is arranged under a 45 degrees angle to the first orthogonal plane. Preferably, the length of the at least one first coupling element is in the range between ¼ and ⅞ of the diameter of the dielectric resonator.

In order to enhance its effect, the at least one first coupling element may comprise coupling buttons at both ends of the bar pointing towards the face surface of the dielectric resonator. Furthermore, there may be at least one first internal coupling element adjustment means like a screw.

Besides the coupling elements, there is a plurality of frequency tuning elements such as tuning rods and/or tuning cuboids. While tuning elements dimensioned as either tuning rods or tuning cuboids can be used, the description below will refer to examples of tuning rods only, to simplify the discussion. For tuning the frequency of the HEEx mode, there may be at least one tuning rod in the first orthogonal plane. Generally, such tuning rods may comprise a dielectric material, preferably a ceramic material. The tuning rods are arranged above and below the dielectric resonator, preferably in close proximity to the first face surface and/or the second face surface of the dielectric resonator. There may also be at least one tuning rod at a side or between resonator sections. For the HEEx mode, there may be a first bottom tuning rod and a third bottom tuning rod, both below the dielectric resonator in the first orthogonal plane, and a first top tuning rod and the third top tuning rod, both above the dielectric resonator in the first orthogonal plane. For adjusting the frequency of the HEEy mode, there may be tuning rods in the second orthogonal plane, like a secand bottom tuning rod and a fourth bottom tuning rod below the dielectric resonator, and a second top tuning rod and the fourth top tuning rod above the dielectric resonator. Generally, any number of tuning rods may be used. In a very simple embodiment, 1 or 2 tuning rods may be sufficient while in a complex embodiment, 8 or more tuning rods may be used. Next to the first coupling element, these tuning rods may be used for tuning the coupling between the HEEx mode and HEEy mode. With increasing asymmetry between the tuning rods coupling between the modes increases. Preferably, pairs of neighbored tuning rods with respect to the center axis are set to the same position. High coupling is achieved, when a first pair of neighbored tuning rods is positioned inward and a second pair of neighbored tuning rods is positioned outward. Preferably, at least one tuning member or element that includes a tuning rod or a tuning cuboid contains a dielectric material and is fastened to the housing and protruding into the cavity outside of the cylindrical dielectric resonator and into a direction towards the center axis above or under at least one of the face surfaces. Furthermore, the projection of an end of at least one tuning rod in a direction parallel to the center axis may be/remains within the bounds of one of the face surfaces. In a related embodiment, at least one tuning member that includes a tuning rod or a tuning cuboid and contains a dielectric material is fastened to the housing and protruding into the cylindrical cavity between ends of a coupling element and the dielectric resonator.

For adjusting the frequency of the HEHx mode, there may be a first side tuning means which is in the first orthogonal plane and preferably opposite to the first external coupling element. Furthermore, for adjusting the frequency of the HEHy mode, there may be a second side tuning means which is arranged at the second orthogonal plane, and preferably opposite to the second external coupling element. The first and the second side tuning means preferably are arranged in a plane between the first support plate and the second support plate.

The first and second side tuning means are similar to the third internal coupling elements, and preferably provide an electrically conductive cylindrical means, which may be adjusted in its depth penetrating into the cavity.

In another embodiment, the first external coupling element and/or the second external coupling element extend radially to the dielectric resonator, and therefore have an extension laterally to the dielectric resonator center axis. At least one the external coupling elements may be arranged in a height (z-axis) between the first face surface and the second face surface of the dielectric resonator. By such an arrangement, the external coupling elements are able to couple an electrical field extending from the dielectric resonator at its cylinder barrel. Most preferably, the external coupling elements are rod-shaped or cylindershaped parts, which preferably protrude through the housing into the cavity in a direction orthogonal to the dielectric resonator center axis. The end of the at least one of the external coupling elements, directed towards the dielectric resonator, may be enlarged to increase coupling efficiency and to improve matching. There may be a cap or a similar structure at its end.

In a further embodiment, an outer conductor is provided at at least one external coupling element. This outer conductor is attached and/or connected to the housing and may have a cylindrical shape. An outer thread may further be provided. By moving the outer conductor in or out, the reference plane may be altered and parasitic couplings between HEHx and HEEy, or HEHy and HEEx may be nullified respectively. Combining this effect with the option to tune the coupling between HEEx and HEEy with the help of the tuning rods or the cuboid tuning elements as mentioned above, it is possible to tune a filter without the need of a first coupling element.

In one embodiment, a microwave or RF bandpass filter includes: a housing of a conductive material defining a cylindrical cavity; at least one cylindrical dielectric resonator having an outer contour defined by a pair of parallel face surfaces, each face surface having at least two symmetry axes, the dielectric resonator having a center axis, where the dielectric resonator is held by holding means within the cavity, where at least one first internal coupling element comprising a conductive or dielectric bar is provided in a plane orthogonal to the cylinder axis.

In another embodiment, a microwave or RF bandpass filter includes: a housing of a conductive material defining a cylindrical cavity; at least one dielectric resonator comprising at least two different sections, each section having an outer contour defined by a parallel pair of face surfaces, each face surface having at least two symmetry axes, and the dielectric resonator having a center axis.

The following features may be combined with and/or used in all embodiments disclosed above.

The dielectric resonator may comprise two cylindrical outer sections distant from each other and may have at least one cylindrical inner section between the outer sections.

The holding means may comprise at least one support plate of a dielectric material, arranged parallel to at least one of the face surfaces, which is further held by the housing.

The dielectric resonator may comprise a ceramic material.

The ratio of dielectric resonator diameter to dielectric resonator height is in the range of 0.9 to 3.1 or in the range between 1.7 and 2.3.

At least one external coupling element may extend from the housing orthogonally to the dielectric resonator center axis.

At least one first internal coupling element may be provided above and/or below the cylindrical dielectric resonator.

At least one of a plurality of conductive third internal coupling elements may be provided protruding into the cavity and being arranged within a plane orthogonally to the dielectric resonator center axis above or under the dielectric resonator.

The dielectric resonator may be displaced axially with respect to the center of the cavity for coupling from a HEHx mode and a HEHy mode to a HEEx mode and a HEEy mode, respectively.

The dielectric material of the dielectric components with exception of the dielectric resonator itself has a dielectric constant which is lower than the dielectric constant of the material of the dielectric resonator and/or may have a thickness which is significantly smaller than the height of the dielectric resonator.

Generally the dielectric material of the dielectric components described herein with exception of the dielectric resonator itself may have a dielectric constant which is lower than the dielectric constant of the materials of the dielectric resonator and/or may have a thickness which is significantly less than the height of the dielectric resonator.

BRIEF DESCRIPTION OF THE DRAWINGS

In the following, the invention will be described by way of example, without limitation of the general inventive concept, on examples of embodiment and with reference to the drawings.

Figure 1:
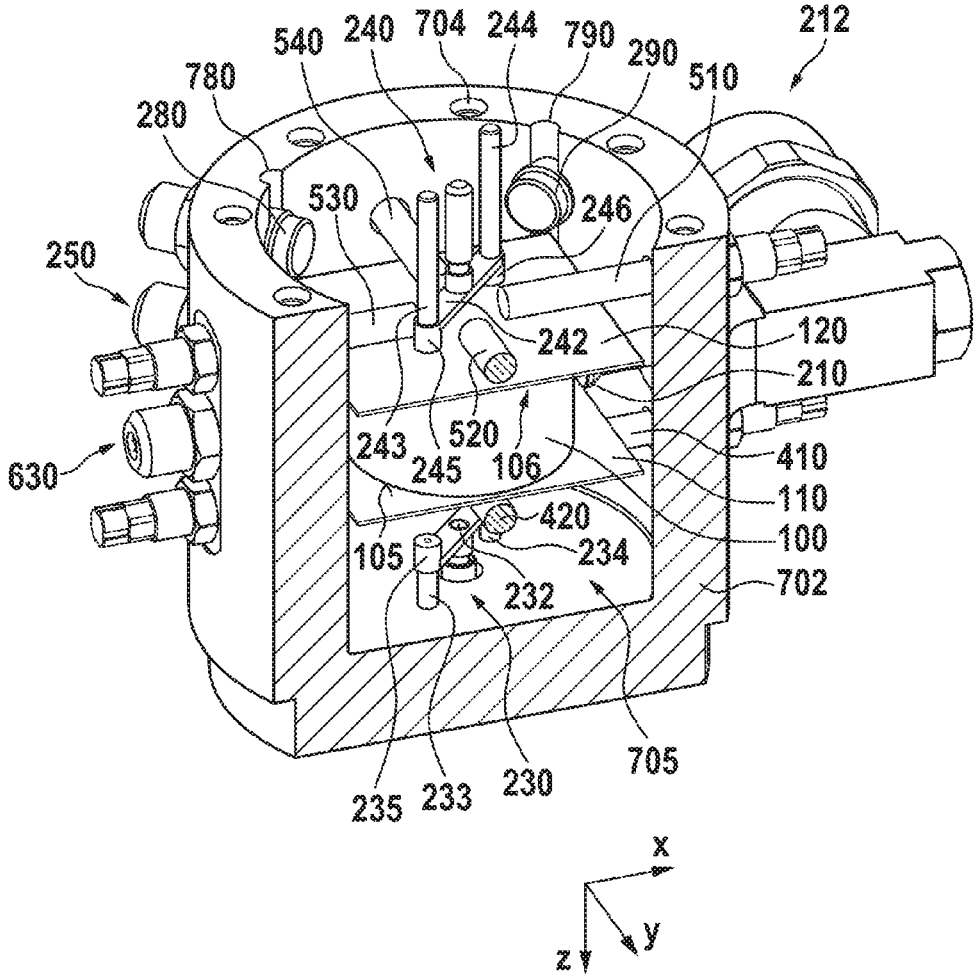
FIG. 1 shows a sectional view of an embodiment.

While the invention can be appropriately modified and assume alternative forms, some specific embodiments thereof are shown as examples, in the drawings, and are described in detail below. It should be understood, however, that the drawings and the corresponding detailed description are not intended to limit the invention to the particular form disclosed, but to the contrary, the intention is to cover all modifications, equivalents and alternatives falling within the spirit and scope of the present invention as defined by the appended claims.

DETAILED DESCRIPTION OF THE INVENTION

Figure 2:
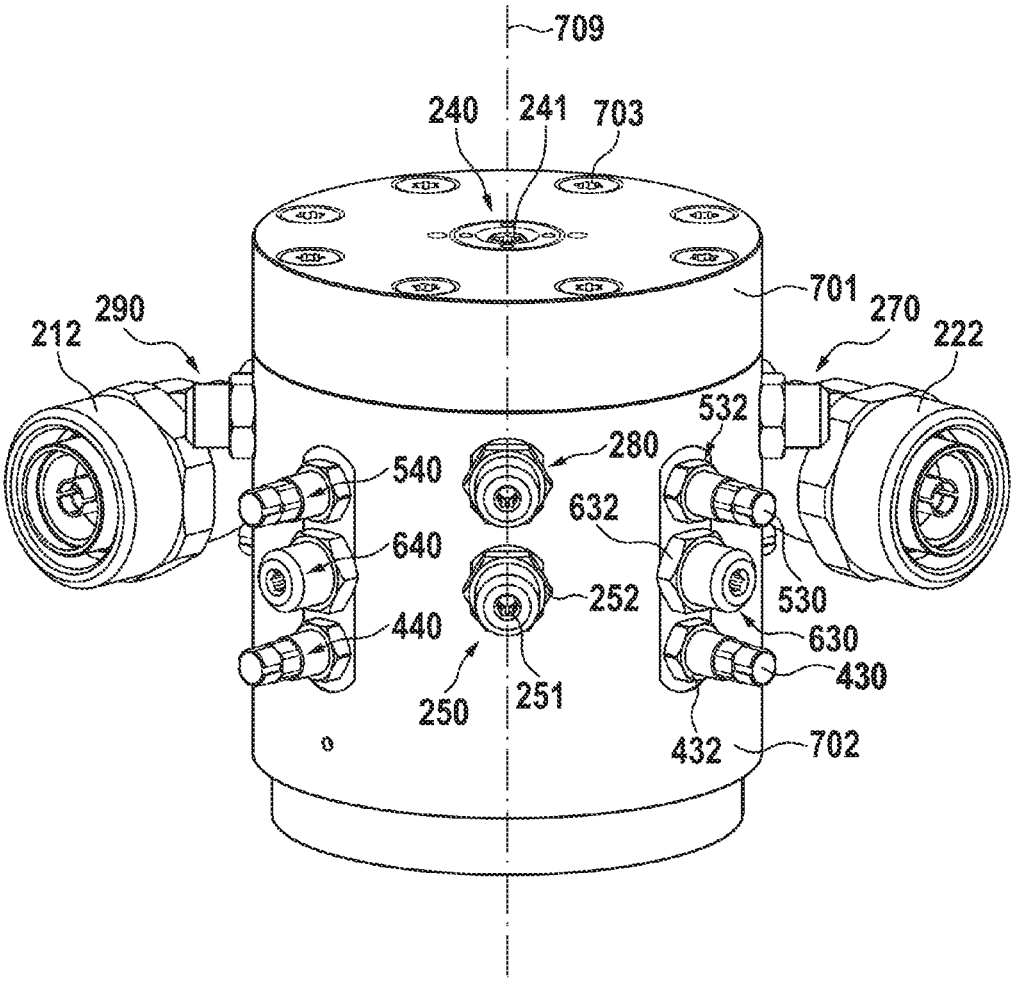
FIG. 2 shows an outside view of an embodiment.
Figure 3:
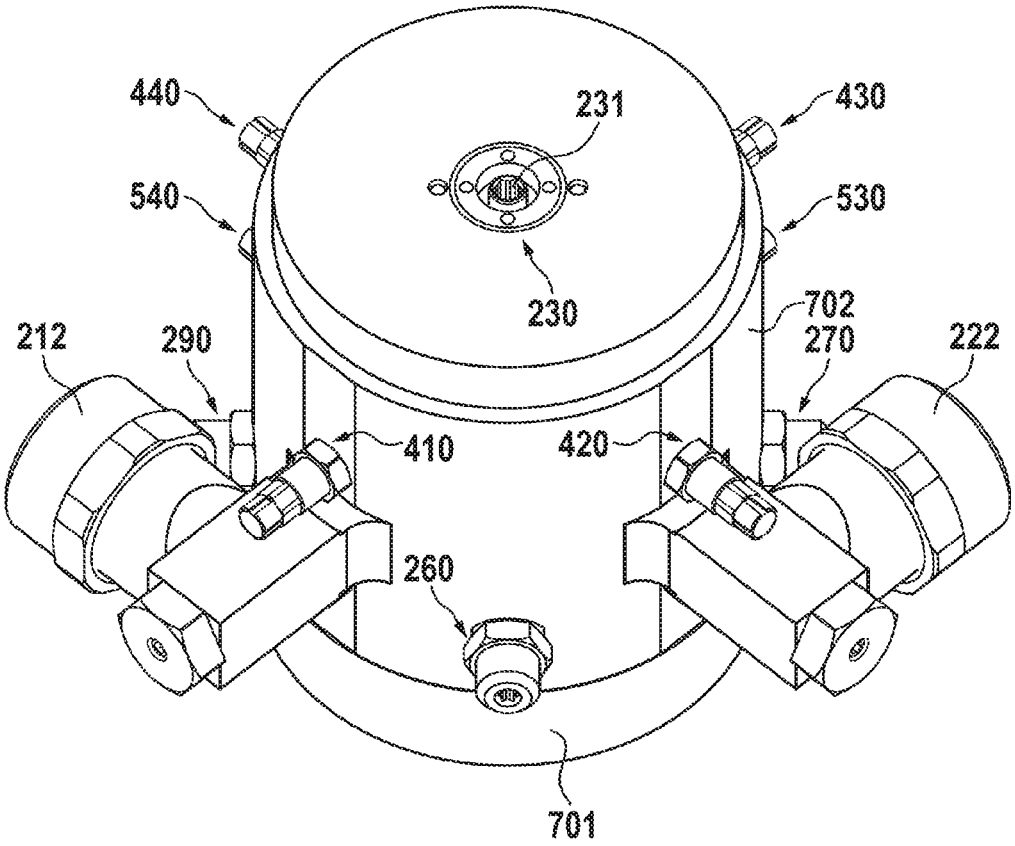
FIG. 3 shows the bottom side of the housing of an embodiment.
Figure 4:
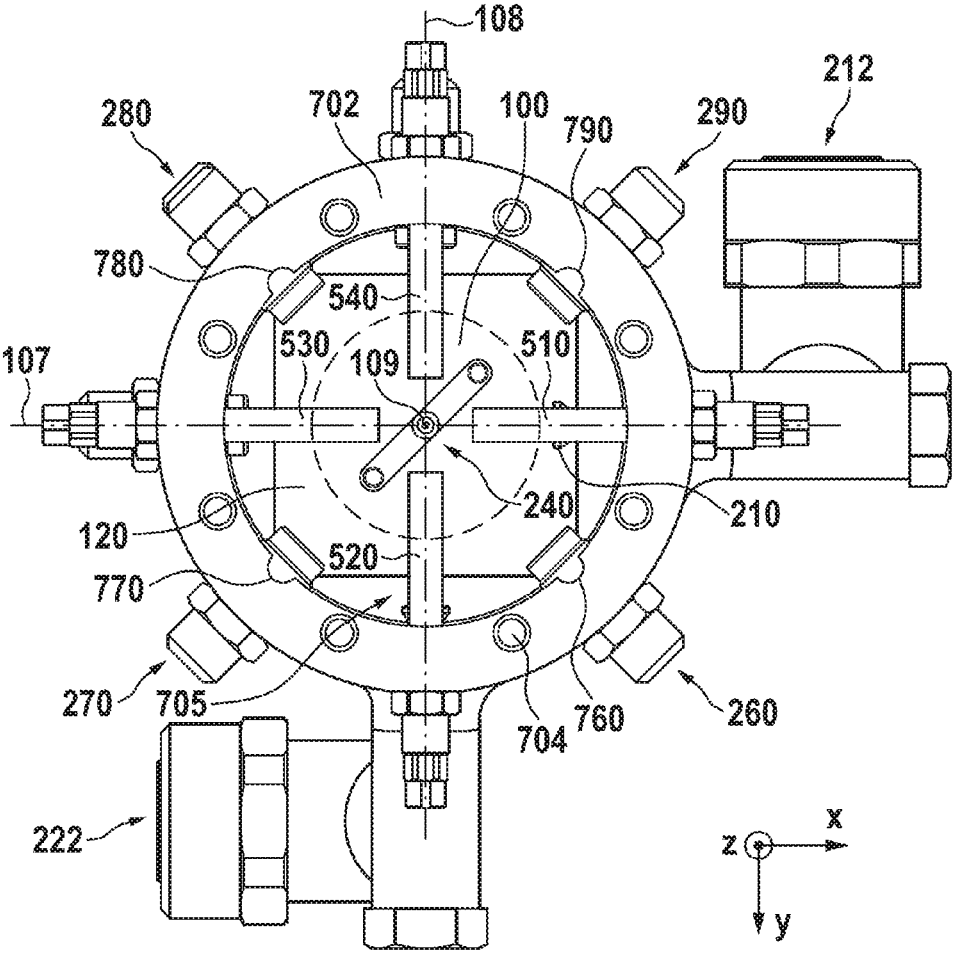
FIG. 4 shows a top view of a housing with removed cover.

The following discussion of structures is presented in reference to FIGS. 1 through 17, where the identified elements of these structures are illustrated. In FIG. 1, for example, a sectional view of a first embodiment, while FIG. 2 illustrates an outside view of the embodiment, and FIG. 4 presents a top view of a housing of the embodiment with the removed cover. In reference to these Figures, a microwave or RF bandpass filter based on a dielectric resonator is shown. A metal housing 702 provides a cavity 705, containing a dielectric resonator 100. Preferably, the cavity 705 has a cylindrical shape defined by a parallel pair of inner face surfaces and further defines a center axis 709 (FIG. 2). The dielectric resonator preferably comprises a dielectric material having low dielectric losses and most preferably a high dielectric constant. The material may be of ceramic. It is preferred, if the dielectric resonator is a cylindrical disk, defined by a parallel pair of face surfaces 105, 106 which most preferably have the same diameter, and define a center axis 109. The cylinder is held within the cavity 705 by means of at least one support plate. Preferably, as shown for example in FIGS. 5, 6, and 7, the dielectric resonator center axis 109 is parallel to the cavity center axis 709, and most preferably these axes are the same, coincide. Preferably, there is a first support plate 110 at the first face surface 105 and a second support plate 120 at the second face surface 106. Preferably, the support plates comprise a material having a low dielectric constant. The material may be one of a plastic material, for example PTFE, or a ceramic material. As the support plates are comparatively thin, there is only a negligible influence on the resonating characteristics of the dielectric resonator 100. It is preferred to use a material with a low or medium dielectric constant which further reduces the influence on the dielectric resonator. The dielectric resonator height 101 and the dielectric resonator diameter 102 (identified in FIG. 12, for example) are selected such that the degenerate HEH and HEE modes resonate at a common resonance frequency. Preferably, the ratio of dielectric resonator diameter to dielectric resonator height is in the range from 0.9 to 3.1. Preferably, the range is between 1.7 and 2.3.

The support plates may be held within the housing 702 by means of grooves 760, 770, 780, 790 (see, for example, FIG. 4) within the inner wall of the cavity 705, which preferably extend parallel to the cavity center axis 709.

Within the cavity 705 is a plurality of coupling elements and tuning elements. There is a first external coupling element 210 of which only a part is shown in this Figure. It is connected to a first external connector 212, which may act as a source feed for the dielectric resonator. It is furthermore preferred to have first internal coupling elements with a bottom first internal coupling element 230 and a top first coupling element 240. Generally, the spatial relations of top or bottom relate to the cavity as shown in FIG. 1, to simplify explanation. It is obvious that these relationships can be exchanged, for example by simply rotating the device.

It is preferred, if at least one of the external coupling elements 210, 220 extends radially to the dielectric resonator or orthogonally to the dielectric resonator center axis 109. It is preferred, if the at least one external coupling element 210, 220 (FIG. 5) is arranged in a height (z-direction) between the first face surface 105 and the second face surface 106 of the dielectric resonator 100.

Preferably, the structure of the bottom first internal coupling element 230 is symmetrical to the structure of the top first internal coupling element 240. These internal coupling elements provide coupling at least of HEEx and HEEy modes within the dielectric resonator. Preferably, they are movable parallel to the cavity center axis 709, most preferably by means of a thread or a screw. Therefore, coupling may be adjusted by moving the first internal coupling elements closer to the dielectric resonator or moving them away therefrom. By the symmetry of these first internal coupling elements, a better coupling and a better mode uniformity within the dielectric resonator can be achieved. Such a symmetrical arrangement is only possible by holding the dielectric resonator between a first support 110 and a second support 120, forming thin plates. If the dielectric resonator would be held by rod-like support as known from related art, it would not be possible to have the lower first internal coupling element 230, as the space required for this coupling element is required by the dielectric resonator support. The first internal coupling elements comprise a bar 232, 242 (see FIG. 1) having coupling buttons 245, 246 at its ends and being mounted to an adjustment screw 231, 241 (FIGS. 2, 3). The position and the movement of the bar 232 is held by support rods 243, 244. The bar preferably is arranged orthogonally to the dielectric resonator center axis 109. As shown in the top view of FIG. 8, for example, the bar 232 is disposed at an angle 238 of 45 degrees to an axis defined between the first external coupling element 210 and the dielectric resonator center axis 109, which also passes through a first orthogonal plane 107.

Furthermore, it is preferred to have at least one second internal coupling element 250 (FIG. 1) and a plurality of third internal coupling elements 260, 270, 280, and 290 (see FIGS. 2, 3). All these second and third internal coupling elements preferably are short conducting studs or cylinders preferably having a circular cross-section, which protrude into the cavity 705 under predetermined angles at predetermined positions. Preferably, the length of the second and third internal coupling elements and therefore the depth of protrusion into the cavity 705 may be adjusted. Adjustment preferably is done by a screw or by means of a thread. Preferably, the center of the second internal coupling element 250 is arranged on a plane having a height between the first face surface 105 and the second face surface 106 of the dielectric resonator 100. Most preferably, it is in the center plane of the dielectric resonator, which is at the center between the first face surface 105 and the second face surface 106. It is furthermore preferred to have the second internal coupling element 250 under an angle of 45 degrees with respect to the first orthogonal plane 107. Further possible positions of the second internal coupling element 250 may be displaced about 90, 180 and 270 degrees around the center axis. Preferably, the second internal coupling element 250 is for coupling the HEHx mode to the HEHy mode. The third internal coupling elements 260, 270, 280, and 290 preferably are arranged within the same plane orthogonally to the dielectric resonator center axis 109, which is further above the second face surface 106 of the dielectric resonator. Alternatively, they may be arranged below the first face surface 105. Preferably, the third internal coupling elements are spaced relatively to each other at angles of 90 degrees, whereas the angle of each third internal coupling element with respect to the first orthogonal plane 107 is 45 degrees.

These third internal coupling elements are for fine-tuning of the coupling the HEHx mode to the HEEx mode and for coupling the HEHy mode to the HEEy mode, respectively. Basically, coupling between these modes is achieved by displacement of the dielectric resonator 100 along the dielectric resonator center axis 109 within the cavity 705, to obtain an offset from the center of the height of the cavity 705. As the height cannot be adjusted, the third internal coupling elements are provided for fine-tuning.

There may be a plurality of side tuning means like the first side tuning means 630 (shown in FIG. 2 with the locking nut 632), which may be used for tuning a first frequency of the HEHx mode.

For frequency tuning of the filter, it is further preferred to provide a plurality of tuning rods. Preferably, there is a first set of tuning rods 410, 420, 430, 440 at the bottom (shown, for example, in FIGS. 5, 8, 9) arranged below the first support plate 110, and/or a second set of tuning rods 510, 520, 530, 540 at the top (see FIG. 9) arranged above the second support plate 120. It is preferred to arrange the tuning rods within the first orthogonal plane 107 or within a second orthogonal plane 108 (see FIG. 4), which is orthogonal to the first orthogonal plane 107. The tuning rods (tuning elements, in general) preferably are made of a material having a high dielectric constant and low dielectric losses. It is preferred to use a ceramic material. The tuning elements (rods, in one case) protrude into the cavity and preferably are adjustable in their length protruding into the cavity.

Herein, angles of 45 and 90 degrees are mentioned. These are preferred values. It is obvious to a person skilled in the art that there may be minor deviations of these angles, as the embodiments would also operate with ranges of the angles between 40 and 50 degrees or 80 and 100 degrees. In the Figure a Cartesian coordinate system is defined, wherein a z-axis is defined by the dielectric resonator center axis in a direction downward in the Figure. An x-axis is defined in the dielectric resonator center plane and in a direction towards the first external coupling element 210. A y-axis is defined in the dielectric resonator center plane and in a direction towards the second external coupling element 220 which is shown in another Figure. Elements 233, 235, and 704 represent, respectively, a support rod, a coupling button, and a screw hole. In the following Figures the same coordinate system is shown for spatial reference, and like numerals are used for designation of like elements or components of the embodiments.

In FIG. 2, an outside view of a preferred embodiment is shown. In this Figure, the housing 702 is closed with the attached cover 701. The cover preferably is locked to the housing 702 by a plurality of cover screws 703. Preferably, the housing has an approximately cylindrical shape defined by two parallel inner face surfaces. In this FIG. 2, the cavity center axis 709 is shown which is defined by the center of the cavity. Preferably, this axis is the same as the center axis of the housing, although this is not necessarily the case. The housing preferably has a first external connector 212 which may be used to feed electrical power into the filter, and a second external connector 222, which may be used to receive electrical power from the filter. A load may be connected thereto.

A plurality of adjustment means are accessible from the outside of the housing for adjusting and tuning the filter. In this view, a third bottom tuning rod 430 and a third top tuning rod 530, as well as a fourth bottom tuning rod 440 and a fourth top tuning rod 540 can be seen. The tuning rods may be secured by means of a third bottom tuning rod locking nut 432 and a third top tuning rod locking nut 532 as shown. It is obvious that the other tuning rods also may have such locking nuts, although no specific reference numbers have been assigned to these locking nuts.

Furthermore, there may be third internal coupling elements 270, 280, 290 as previously described. These third internal coupling elements may also have locking nuts similar to the previously mentioned tuning rod locking nuts.

Furthermore, a second internal coupling element 250 is shown. This may also be locked by a second internal coupling element locking nut 252. Adjustment may be made by a second internal coupling element adjustment screw 251, which may have a hexagon socket.

At the top of the cover 701, parts of the top first internal coupling element 240 are shown. It may be adjusted by the top first internal coupling element adjustment screw 241, which may preferably have a hexagon socket.

In FIG. 3, the bottom side of the housing of a preferred embodiment is shown. Close to the first and second external connectors 212, 222, there are first and second bottom tuning rods 410 and 420. At the center of the bottom of the housing, a bottom first internal coupling element 230 is shown, which may be adjusted by a bottom first internal coupling element adjustment screw 231.

In FIG. 4, a top view of the housing 702 with removed cover 701 (FIG. 2) is shown. The housing 702 forms a cavity 705, in which the dielectric resonator 100 is located with its dielectric resonator center axis 109, a first orthogonal plane 107 and a second orthogonal plane 108 with their intersection at the center axis. In this FIG. 4, a plurality of screw holes 704 for holding the cover screws 703 (shown in FIG. 2) are illustrated. Furthermore, the third internal coupling elements 260, 270, 280, and 290 are shown, which are in a plane above the second support plate 120, which furthermore is above the dielectric resonator 100, which is only indicated but cannot be seen, as it is covered by the second support plate 120. Furthermore, a first top tuning rod 510, second top tuning rod 520, third top tuning rod 530, and fourth top tuning rod 540 are shown. Preferably, there are four grooves 760, 770, 780, 790 for holding the first support plate 110 and the second support plate 120 shown in FIG. 1, which support plates preferably fit with their corners into the grooves and may slide along parallel to the cavity center axis 709 (FIG. 2).

Figure 5:
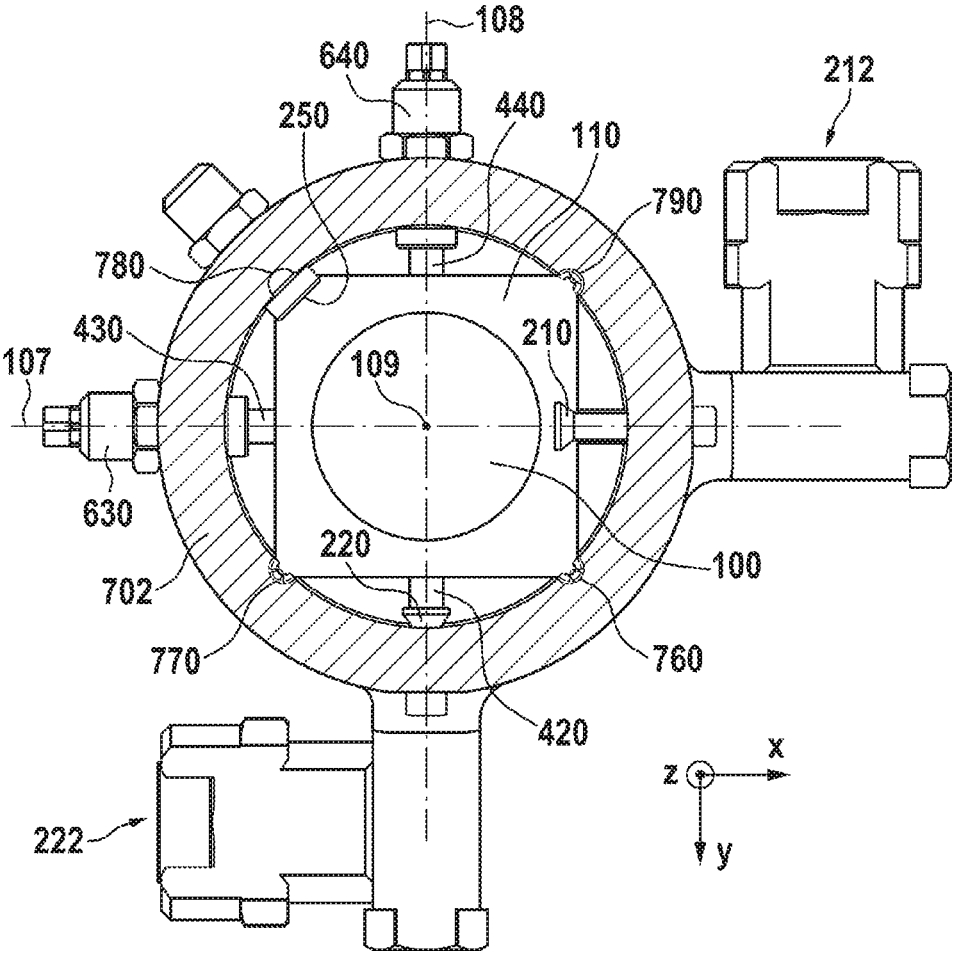
FIG. 5 shows a sectional view from the top through a plane A-A drawn below the second support plate (as marked in FIG. 9).

In FIG. 5, a sectional view from the top in a plane A-A (marked in FIG. 9) that is drawn below the second support plate 120 (of FIG. 1) is shown. Here, the first external coupling element 210 and the second external coupling element 220 (FIG. 8) are shown in more detail. It is preferred to have the first external coupling element 210 closer to the dielectric resonator 100 (FIG. 1) than the second external coupling element 220. Preferably, at least one of the coupling elements has an extended head oriented towards the dielectric resonator. Furthermore, the second internal coupling element 250 is shown, which is in approximately the same plane as the first external coupling element and the second external coupling element, the plane being orthogonal to the dielectric resonator center axis 109. It preferably has the shape of a conductive cylinder, which is adjustable in its length and which is protruding into the cavity. Furthermore the first side tuning means 630 and the second side tuning means 640 for adjusting the HEH frequency are shown.

Figure 6:
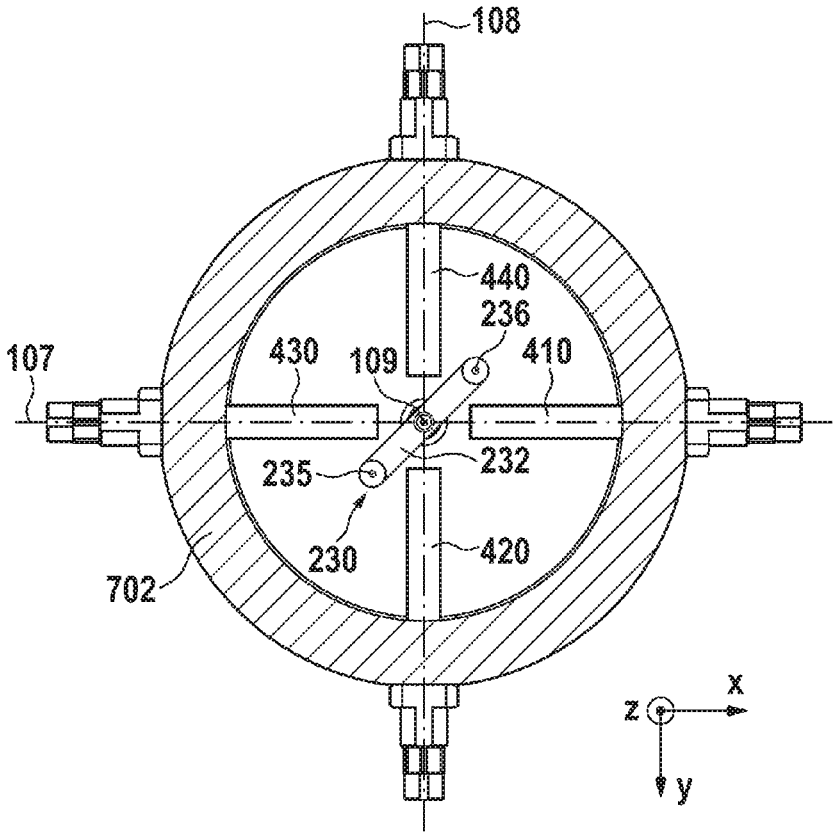
FIG. 6 shows a further sectional view from the top, from a plane B-B drawn below the first support plate (as marked in FIG. 9).

In FIG. 6, a further sectional view from the top is shown, from a plane B-B (marked in FIG. 9) that is located below the first support plate 110 of FIG. 1. Here, the first bottom tuning rod 410, second bottom tuning rod 420, third bottom tuning rod 430, and fourth bottom tuning rod 440 are shown. Furthermore, the bottom first internal coupling element 230 is shown.

Figure 7:
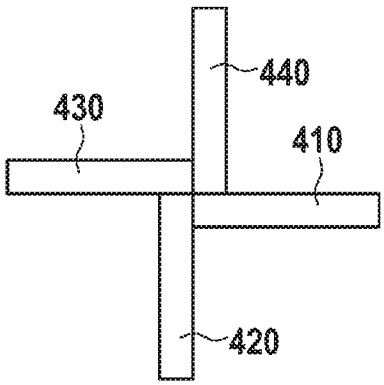
FIG. 7 shows a modified embodiment.

FIG. 7 shows a modified embodiment, where the center axis of the tuning rods are slightly offset, preferably for half the diameter of a tuning rod. By this, the tuning rods may be moved with their ends together without forming a gap.

Figure 8:
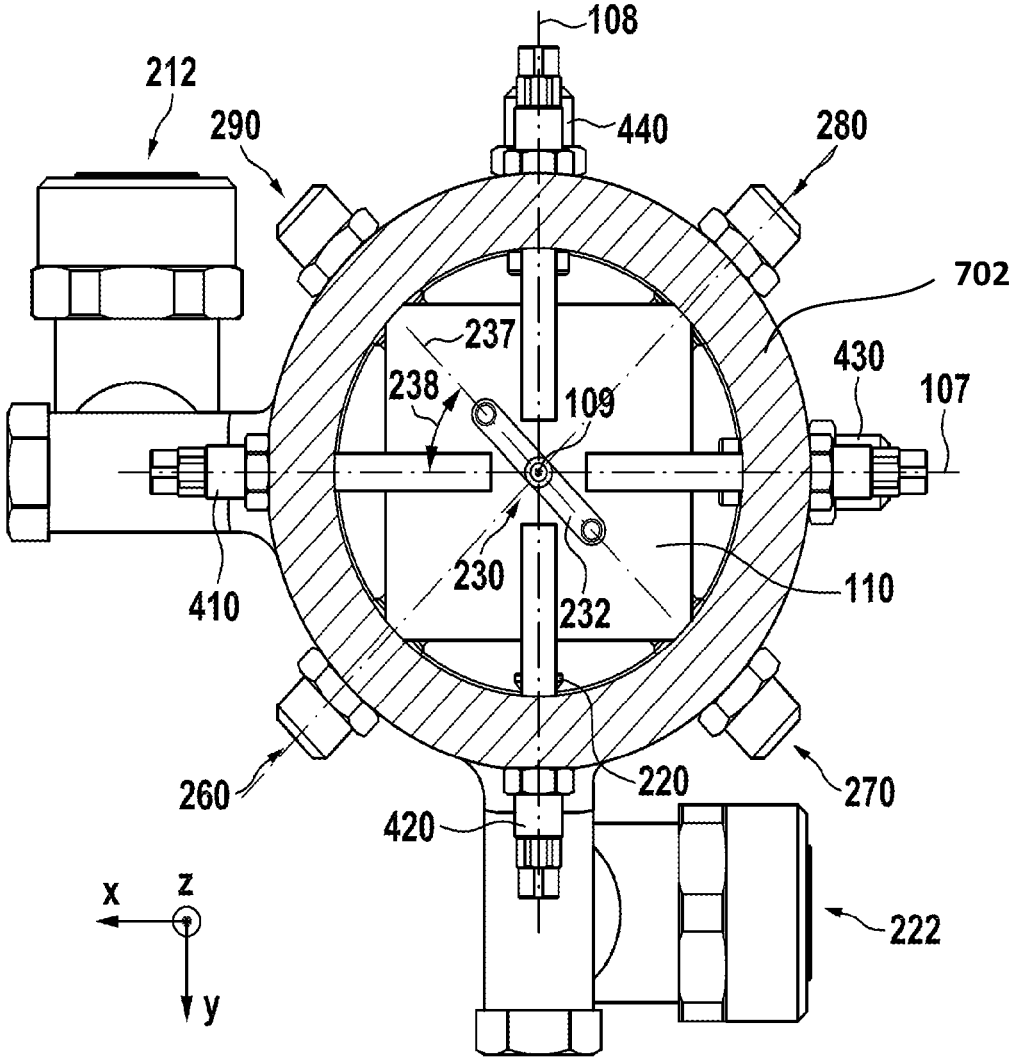
FIG. 8 shows a sectional view (formed with the use of plane C-C drawn as marked in FIG. 9) from the bottom of an embodiment.

FIG. 8 presents a view of a portion of the embodiment from the bottom towards the first support plate 110. This is the view from a cross-sectional plane C-C (marked in FIG. 9). As it is preferred to have the grooves 760, 770, 780, ending at a position corresponding to the position of the first support plate 110, these grooves are not shown in this FIG. 8. In this view, the first bottom tuning rod 410, second bottom tuning rod 420, third bottom tuning rod 430, and fourth bottom tuning rod 440 are shown. Preferably, each of these bottom tuning rods is held by a nut in the housing 702 (FIG. 1). There may further be a means like a collet to firmly hold the tuning rods in a position. For tuning the filter, the length of the tuning rods protruding into the cavity can be adjusted and preferably later be fixed, so that the tuning rods would not move over time. In this FIG. 8, furthermore a bottom first internal coupling element 230 is shown. It preferably has a bar 232, whereas the bar preferably has an axis 237, which is under an angle 238, as shown in FIG. 8, of about 45 degrees to the first orthogonal plane 107.

Figure 9:
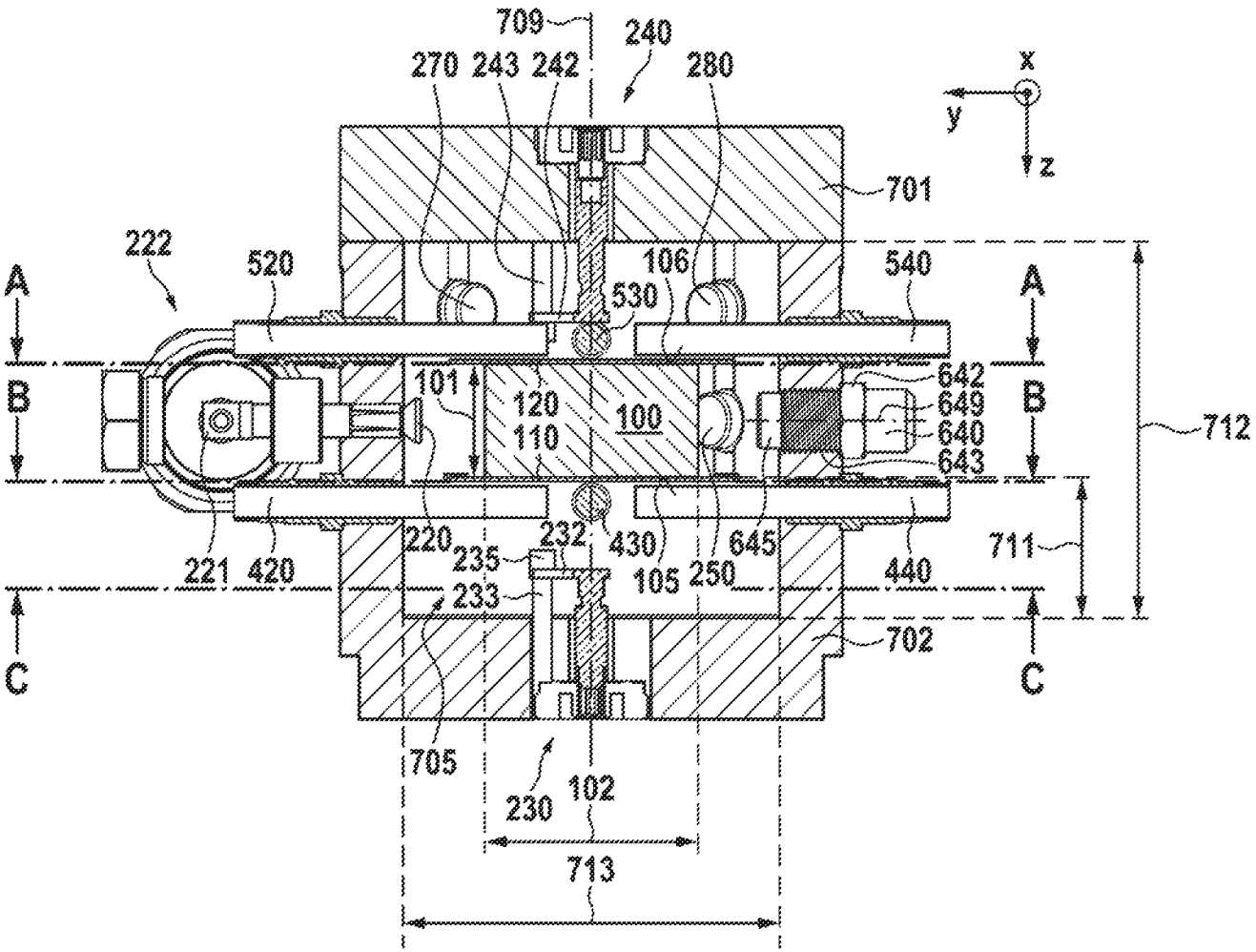
FIG. 9 shows another sectional view of an embodiment.

In FIG. 9, a sectional view of a preferred embodiment is shown. Here again, some of the previously mentioned components can be seen. This Figure shows some more details, for example a sectional view of the second side tuning means 640, which is exemplarily for the other stud-type tuning means disclosed herein. It may have an outer thread 643 to be held in the housing 702, and a locking nut 642 for securing within the housing. Furthermore, there may be a screw or slider 645 which may be actuated along its center axis 649, preferably by means of a screw internal to the second side tuning means. This second side tuning means may be provided for tuning a fourth frequency of the HEHy mode. In this FIG. 9, furthermore a preferred connection of external connectors is shown. Here, the second external connector 222 (FIG. 2) has a second external inner conductor 221 which is connected to the second external coupling element 220. There may be means for adjusting the length or the depth of protrusion into the cavity of the second external coupling element 220. This Figure further shows some essential dimensions of the embodiment. The dielectric resonator 100 has a dielectric resonator diameter 102 and a dielectric resonator height 101. The cavity 705 has a diameter 713 with a center axis 709. It furthermore has a height 712. The dielectric resonator 100 is mounted such as to have a height 711 above the bottom of the cavity 705. Preferably, the center of the dielectric resonator 100 is slightly offset to the center of the height 712 of the cavity.

Figure 10:
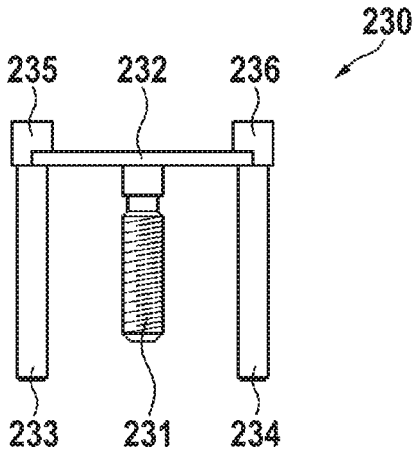
FIG. 10 shows a detail of a first internal coupling element.

In FIG. 10, a detail of a first internal coupling element is shown. Here, the bottom first internal coupling element 230 comprises a bar 232 which is rotatably coupled to an adjustment screw 231. Preferably, the screw 231 has a hexagon socket or similar means for rotating the screw at the end distant from the bar. By rotating the adjustment screw 231, the height of the bar with respect to the housing and therefore with respect to the dielectric resonator can be adjusted. As was discussed in reference to FIG. 8, for example, the bar 232 preferably is disposed at an angle of 45 degrees to the first orthogonal plane 107. Accordingly, the bar 232 it must not rotate when the adjustment screw 231 is rotated. To prevent the rotation of the bar 232, preferably at least one support rod 233, 234 is provided. Coupling buttons 235, 236 are provided at the bar and being directed towards the dielectric resonator 100. These coupling buttons allow to place the bar at a larger separation from the resonator, preferably to keep the bar distant from the upper and/or lower tuning rods. The coupling buttons 235, 236 are electrically connected by means of the bar 232. Preferably, the top first internal coupling element 240 is identical with a bar 242, support rods 243, 244 and coupling buttons 245, 246.

Figure 11:
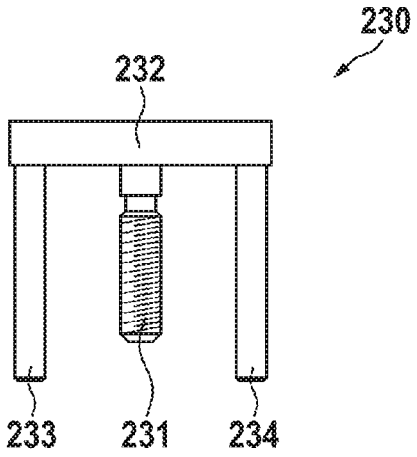
FIG. 11 shows a detail of a further internal coupling element.

In FIG. 11, a detail of a further internal coupling element is shown. Here, the bottom first internal coupling element 230 comprises a bar 232 which is rotatably coupled to an adjustment screw 231. The bar may comprise a dielectric material or a conductive material. It may have a circular or a rectangular cross section.

Figure 12:
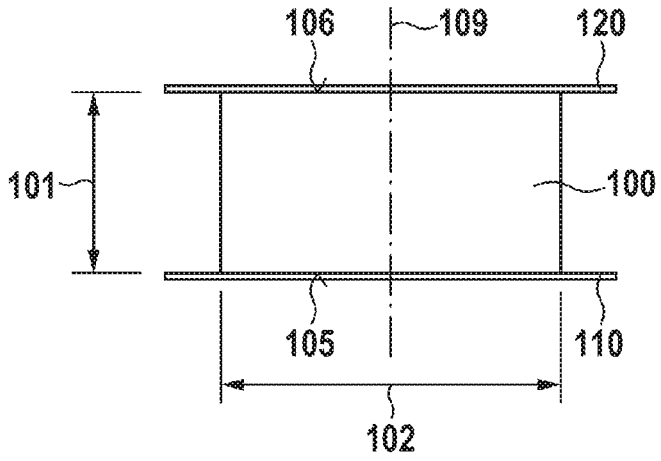
FIG. 12 shows a dielectric resonator in detail.

In FIG. 12, a dielectric resonator is shown in detail. The dielectric resonator 100 is preferably defined by two parallel face surfaces 105, 106 forming a cylinder having a height 101 which is defined by the distance of the parallel face surfaces 105, 106 and a diameter 102. Preferably, the dielectric resonator 100 is held by a first support plate 110 and a second support plate 120. The first support plate 110 preferably is at the first face surface 105, whereas the second support plate 120 preferably is at the second face surface 106. It is obvious, that minor deviations from the general shape like an elliptical shape, chamfers others do not affect the general operation principle of the embodiment.

Figure 13:
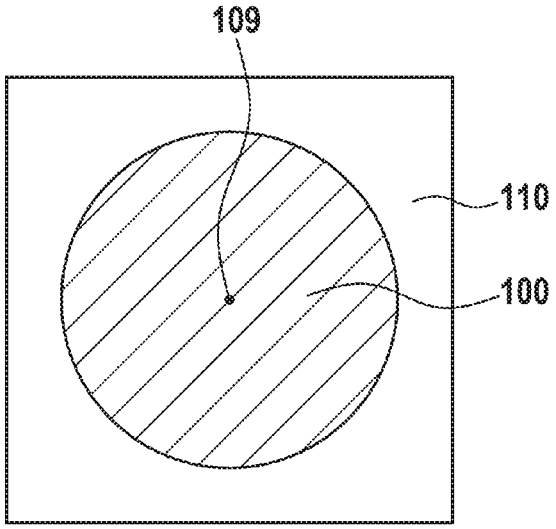
FIG. 13 shows a sectional top view of a dielectric resonator.

In FIG. 13, a sectional top view of a dielectric resonator 100 is shown. At the center, there is a dielectric resonator center axis 109.

Figure 14:
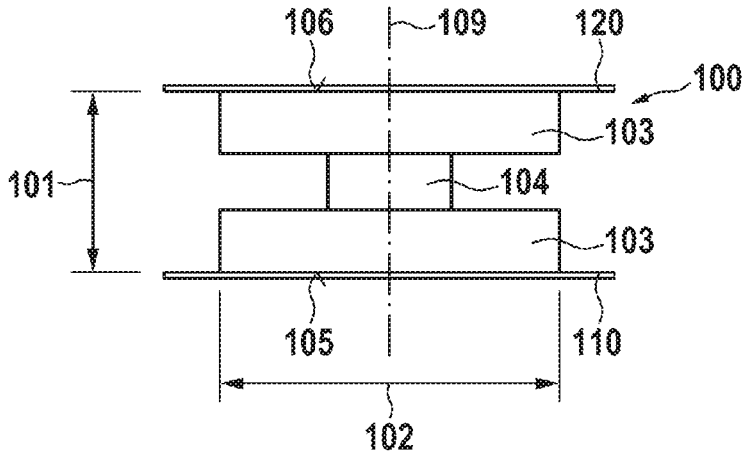
FIG. 14 shows another embodiment of a dielectric resonator in detail.

In FIG. 14, another dielectric resonator is shown in detail. The dielectric resonator 100 comprises a pair of outer sections 103 and an inner section 104 between the outer sections. In this embodiment, all sections are of a cylindrical shape having circular top and bottom surfaces. Preferably, all sections comprise dielectric material. Preferably, the overall contour of the resonator 100 as defined by the larger outer sections is a cylindrical contour, which corresponds to the outer contour of the dielectric resonator shown above. Therefore, this resonator may be used in all embodiments described herein. It is further preferred, if the outer sections 103 and the inner section 104 are centered about a common center axis 109. In another preferred embodiment, the inner section comprises a material different from the outer sections. Preferably, the material of the inner section is selected such that its thermal changes in its electrical and/or mechanical properties compensate changes in the electrical and/or mechanical properties of the outer sections. Thus, a thermal compensation can be achieved, resulting in a broader temperature range with constant operating characteristics.

Figure 15:
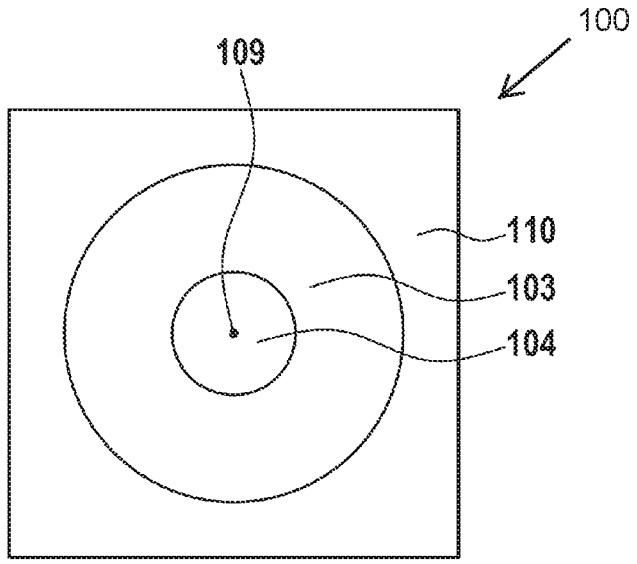
FIG. 15 shows a sectional top view of the above dielectric resonator.

In FIG. 15, a sectional top view of a dielectric resonator 100 (of FIG. 1) is shown. At the center, there is a dielectric resonator center axis 109.

Figure 16:
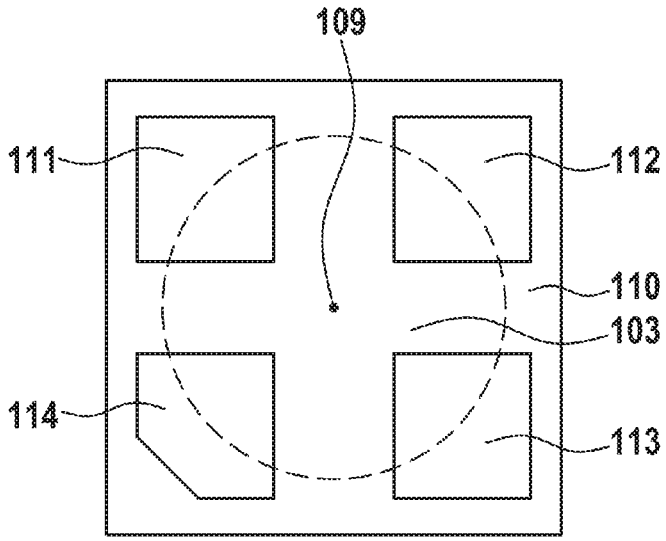
FIG. 16 shows a modified support plate.

In FIG. 16, a modified support plate 110 is shown. Either one of the support plates or both may be modified accordingly. There may be at least one compensation plate 111, 112, 113, 114 attached to the surface of a support plate. Preferably, the at least one compensation plate is arranged close to the corners of the support plate. The at least one compensation plate may be at the side of the support plate opposite to the dielectric resonator 100. Although it is also possible to arrange the at least one compensation plate at the same side. The at least one compensation plate preferably comprises a dielectric material, most preferably the same or a similar material as the support plate. The dielectric material of the at least one compensation plate as well as the dielectric material of the support plate are penetrated by the fields of the HEH modes and therefore may influence the HEH mode, but not the HEE modes. Therefore the compensation plates may be used for selective temperature compensation of the HEH modes, if the temperature coefficient of the compensation plates is selected accordingly. At least one of the compensation plates may have a chamfered outer edge to minimize the influence to the HEE modes. This is shown exemplarily by compensation plate 114. It may be sufficient to provide at least one pair of opposing compensation plates (111, 113) or (112,114). The compensation plates shown herein may have a thickness in a range between 0.5 mm and 5 mm. In a further embodiment, at least one additional compensation plate (111, 112, 113, 114) is modified by at least one cut edge. Furthermore, at least one additional compensation plate may comprise a dielectric material having a dielectric constant which is lower than the dielectric constant of the materials of the dielectric resonator and/or may have a thickness which is significantly less than the height of the dielectric resonator.

Figure 17:
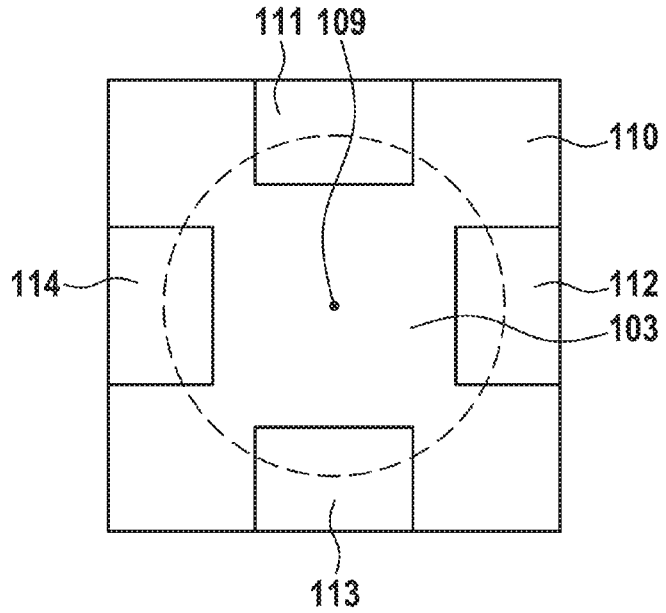
FIG. 17 shows a further modified support plate.

In FIG. 17, a further modified support plate 110 is shown. Here, the compensation plates 111, 112, 113, 114 are arranged along the edges of the support plate.

Figure 18:
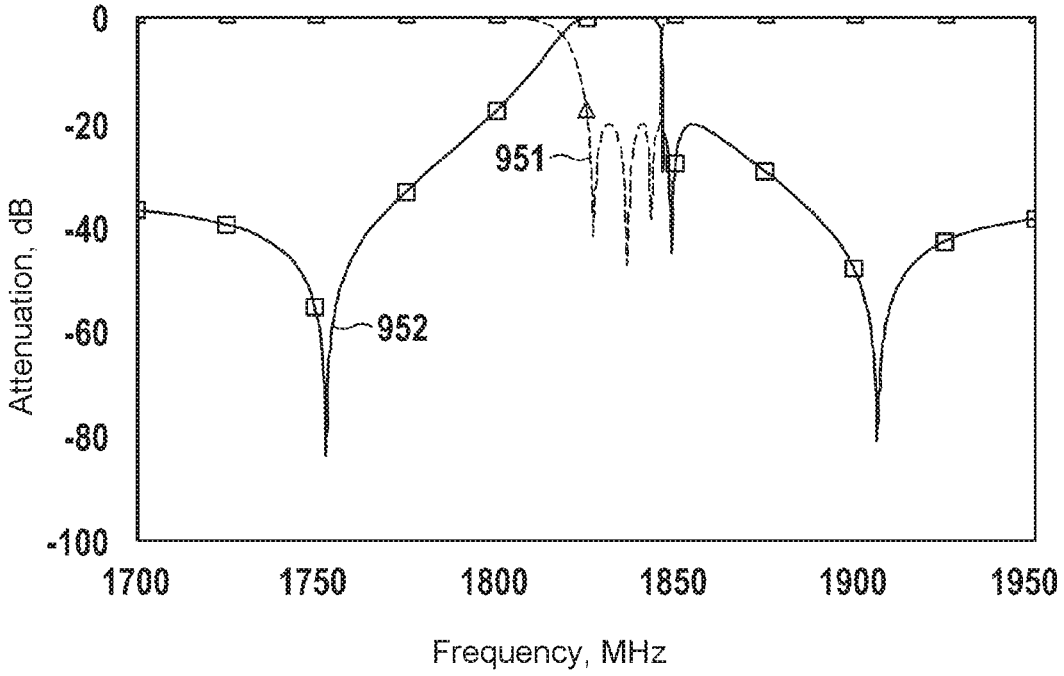
FIG. 18 shows S parameters of an embodiment.

In FIG. 18, electrical characteristics defined by their S-parameters of a preferred embodiment are shown. This diagram has a horizontal axis showing a frequency in MHz starting with 1700 MHz at the left side and ending with 1950 MHz at the right side. At the vertical axis, it shows attenuation in dB (decibels) starting from 0 dB at the top and ending with −100 dB at the bottom. A first curve 951 shows S11 which is the signal reflected at the first external connector 212 (FIGS. 3, 4) with relation to a signal fed into this connector. The second curve 952 shows S21 which is the attenuation of a signal at the second external connector 222 (FIGS. 3, 4) related to an input signal at the first external connector 212. These curves result from a filter as described herein, where the cavity has a diameter of 60 mm and a height of 60 mm. The outer dimensions of the resonator are 34 mm diameter and 18 mm height. The resonator has relative dielectric constant of 36.

Figure 19:
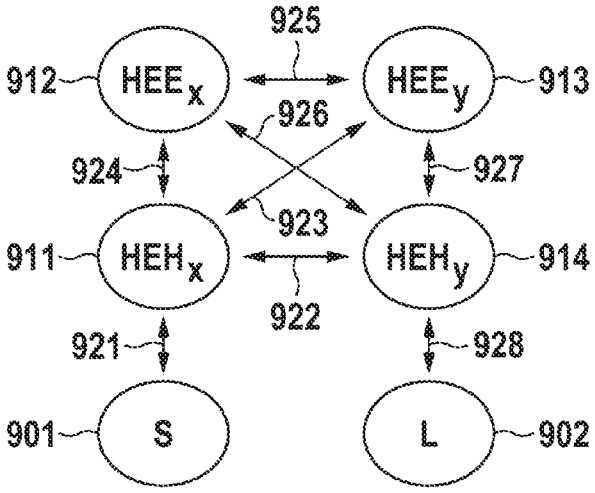
FIG. 19 shows a coupling scheme of coupling modes within the filter.

In FIG. 19, a coupling scheme of coupling modes within the filter is shown. There are four modes. A HEHx mode has a first frequency, a HEEx mode has a second frequency, a HEEy mode has a third frequency and HEHy mode has a fourth frequency. A signal is input at a source (S) 901 and coupled via coupling path 921 with the HEHx mode 911 of the filter. Energy is coupled from this mode via coupling path 922 with the HEHy mode 914, via coupling path 923 with the HEEy mode 913 and via coupling path 924 with the HEEx mode 912. From the HEEx mode, energy may be coupled via coupling path 925 with the HEEy mode 913 or with said HEHy mode 914 via coupling path 926. The HEEy mode 913 may couple energy with the HEHy mode 914 via coupling path 927. Energy may be coupled from the HEHy mode 914 via coupling path 928 to the load (L) 902. All these couplings are reciprocal and therefore bidirectional.

Figure 20:
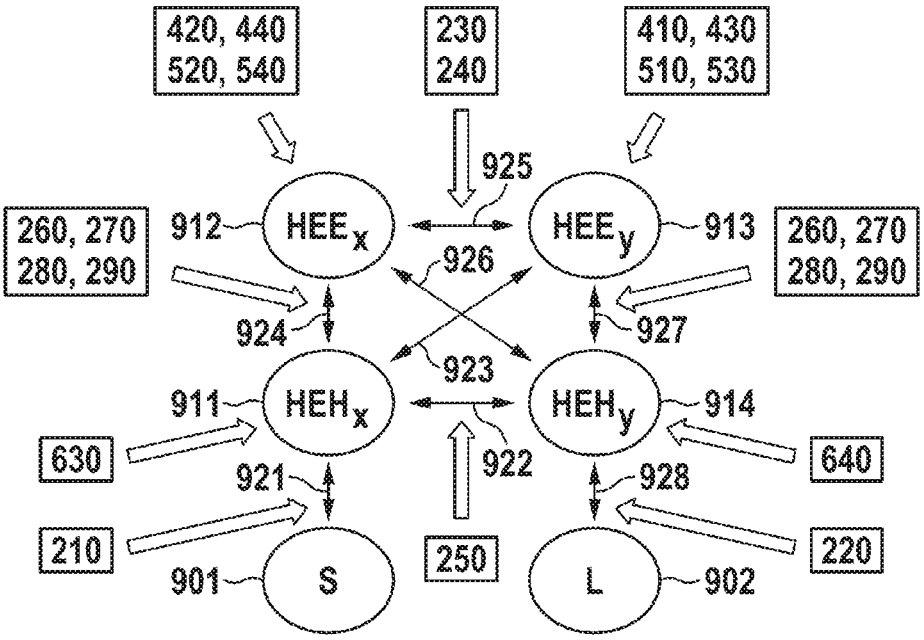
FIG. 20 shows an extended coupling scheme.

FIG. 20 shows the same coupling scheme of FIG. 14, but with added reference sign of the relevant elements. For example coupling between the HEEx mode 912 and the HEEy mode 913 via coupling path 925 is done by means of the bottom first internal coupling element 230 and the top first internal coupling element 240 (shown, for example, in FIG. 1).

Figure 21:
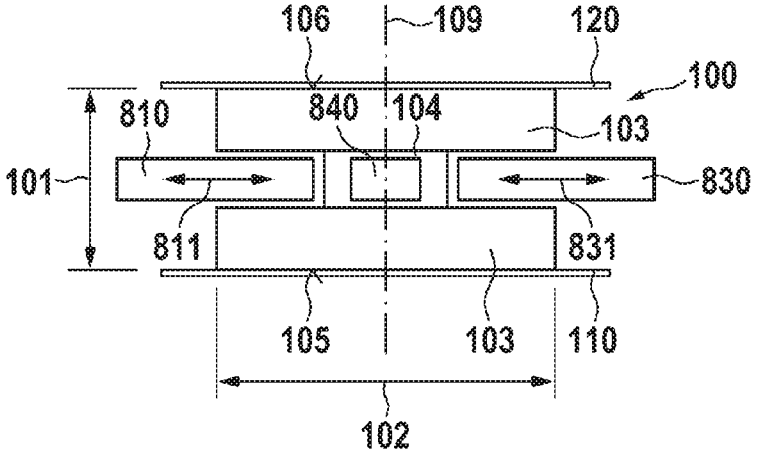
FIG. 21 shows tuning elements between two resonator sections in a side view.

FIG. 21 shows coupling elements intersecting the space between two cylindrical dielectric resonator sections in a side view. These coupling elements may be cuboid.

Figure 22:
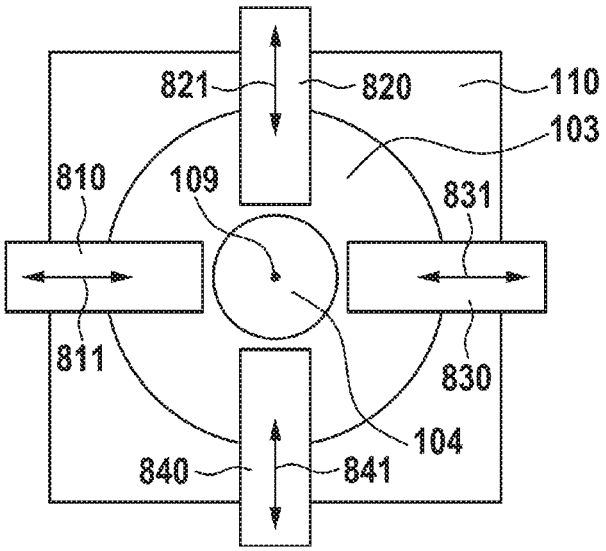
FIG. 22 shows tuning elements between two resonator sections in a top view.

FIG. 22 shows corresponding to FIG. 21 a sectional top view cut in half transversally to the z-axis at the center of the z-axis. There are preferably four coupling elements 810, 820, 830, 840 preferably of a dielectric material which preferably are evenly angular spaced around the center axis 109. They are preferably movable in axial directions as indicated by direction indicators 811, 821, 831, 841. The coupling elements may be moved into the space between the outer sections 103. With these coupling elements, it is possible to interact directly with the field lines of the HEEx and HEEy mode. Without the separation into an upper and a lower dielectric resonator section, only the field lines leaking out of the resonator are available for tuning. With this setup, a direct access to the field lines is opened up. Thus, by shifting the coupling elements in and out symmetrically over all entities, it is possible to shift HEE frequencies. By shifting the coupling elements unevenly, coupling between the HEE modes appear. By using these coupling elements, the bottom and top tuning rods are no more required.

Figure 23:
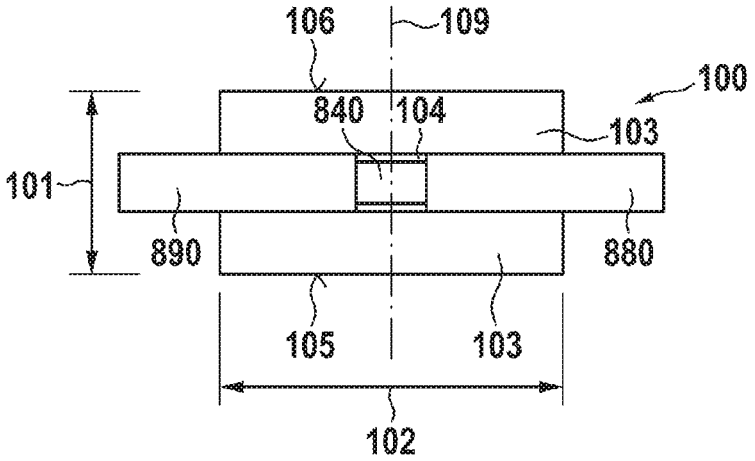
FIG. 23 shows holding of the resonator by spacers in a side view.
Figure 24:
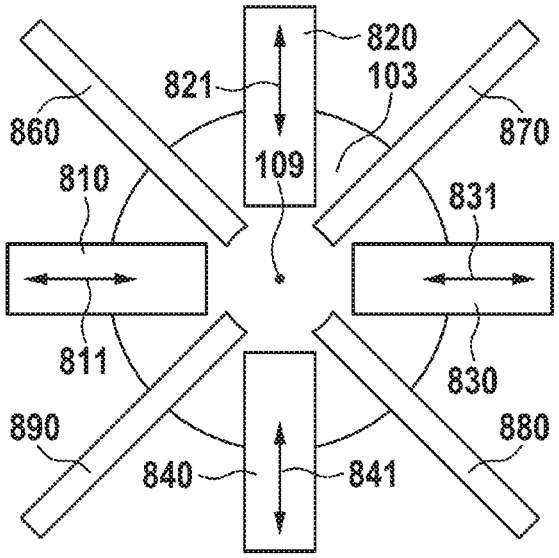
FIG. 24 shows holding of the resonator by spacers in a top view.

A further embodiment is shown in FIG. 23 (in a side view) and in FIG. 24 (in a corresponding sectional top view). At least one spacer 860, 870, 880, 890 between the two cylindrical resonator sections may be used for holding the resonator within the cavity. Here, the resonator sections preferably are glued together with the at least one spacer.

The at least one spacer 860, 870, 880, 890 is extended outwards so far that it may touch the walls of the cavity. Using thin strips, as shown in this Figure provide enough space for the coupling elements shown in FIG. 22. There may be any number of spacers. There may be multiple separated spacer sections. Also, the spacer sections or spacers may be combined to a single piece spacer. In this embodiment, the support plates are no more required.

Figure 25:
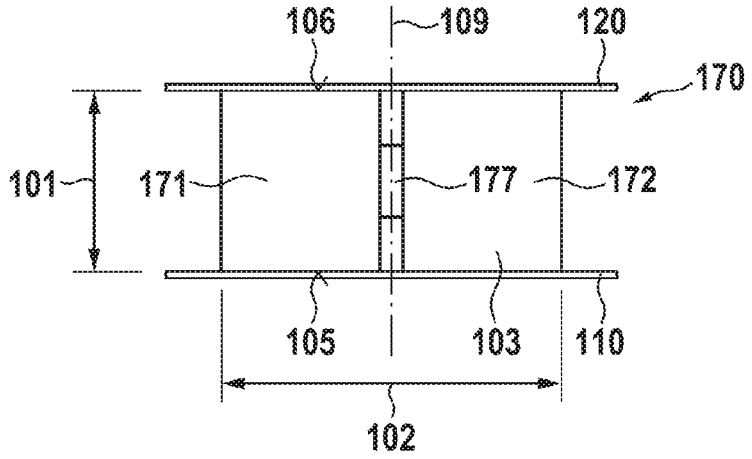
FIG. 25 shows a resonator split into multiple parts allowing access to the electrical/magnetic fields pointing from one part to another.
Figure 26:
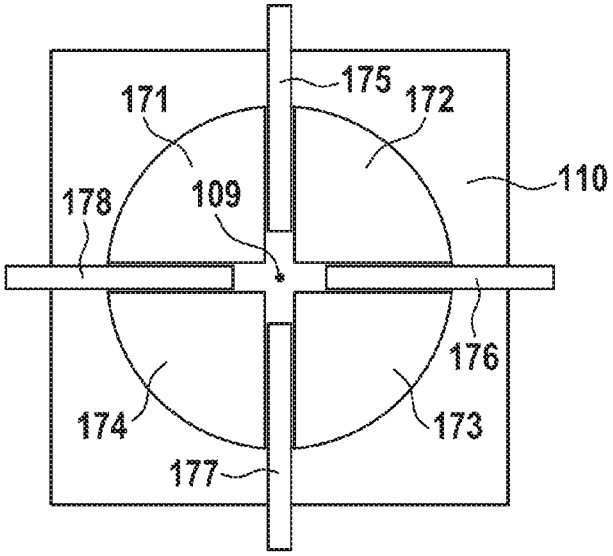
FIG. 26 shows the above resonator in a sectional top view

FIGS. 25, 26 respectively show a resonator 170 in a side view and a sectional top view. The resonator 170 is split into multiple sections 171, 172, 173, 174 that allow access to the electrical/magnetic fields pointing from one part to another. Preferably, each section is a cylinder section, most preferably having a sectional angle of about 90 degrees. It is preferred to have spaces between the sections 171, 172, 173, 174 for inserting coupling elements 175, 176, 177, 178 (FIG. 26). In extension of the multiple dielectric resonators shown above, it is possible to use resonators which are split into more pieces (see above). This gives access to even more slits where tuning and coupling elements may be positioned. This embodiment allows to hold first internal coupling elements 230, 250 (shown in FIG. 9, for example) in their positions. In normal operation, by moving the first coupling element along the z-axis, the electrical field between the nearest resonator's face surface and the first coupling element are tuned. This tuning may also be done by pushing a dielectric rod or slab between the first coupling element and the dielectric resonator.

As mentioned above, FIG. 26 shows the resonator 170 of FIG. 25 in a sectional top view.

Figure 27:
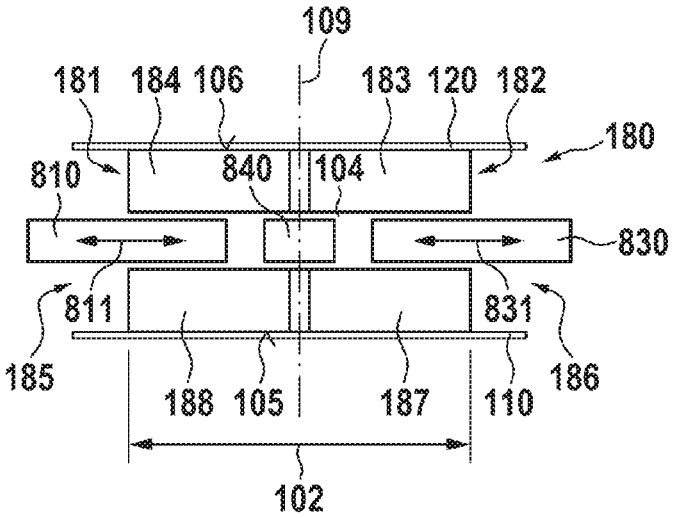
FIG. 27 shows a further resonator split into multiple parts allowing access to the electrical/magnetic fields pointing from one part to another.
Figure 28:
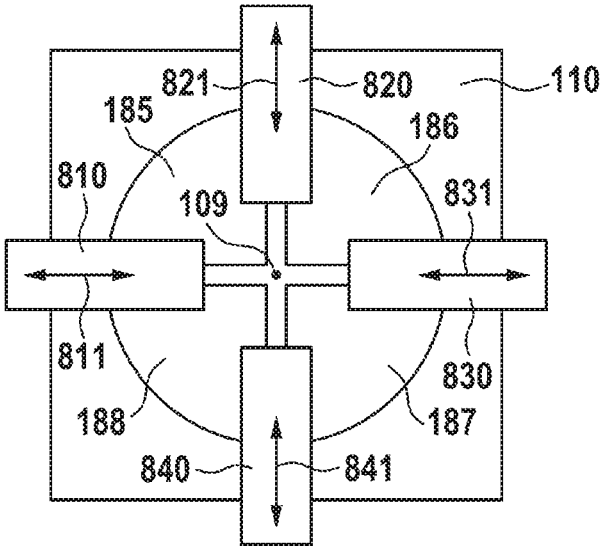
FIG. 28 shows the above resonator in a sectional top view

FIGS. 27, 28 show an embodiment 180 of a resonator in different views. FIG. 27 shows a resonator 180, in a side view, split into first multiple sections 181, 182, 183, 184 and second multiple sections 185, 186, 187, 188 allowing extended access to the electrical/magnetic fields pointing from one part to another. The sections 181 and 183 are hidden behind the sections 184 and 183. Preferably, each of the first and second sections is a cylinder section, most preferably having a sectional angle of about 90 degrees. It is preferred to have spaces between the sections for inserting coupling elements (such as the coupling elements 175, 176, 177, 178 for example). This embodiment allows to hold first coupling elements 230, 250 (shown, for example, in FIG. 9) in their positions. In normal operation, by moving the first coupling element along the z-axis, the electrical field between the nearest resonator's face surface and the first coupling element are tuned. This tuning may also be done by pushing a dielectric rod or slab between the first coupling element and the dielectric resonator.

FIG. 28 shows the above resonator in a sectional top view. Here, the second resonator sections 185, 186, 187, 188 can be seen from the top. Sections 181, 182, 183, 184 which are not shown herein have basically the same shape and are positioned above the sections 185, 186, 187, 188.

Figure 29:
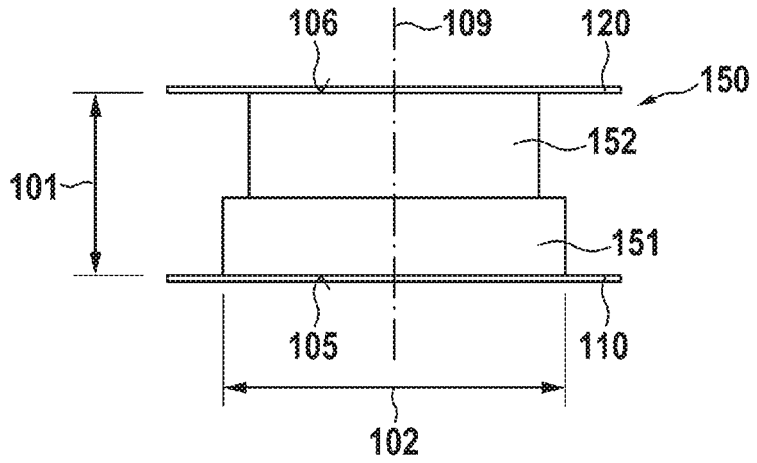
FIG. 29 shows stacked dielectric cylinders with different diameter.

FIG. 29 shows a further embodiment having a resonator 150 comprising multiple stacked dielectric cylinders 151, 152 with different diameters. This embodiment shows a first resonator cylinder 151 having a larger diameter and a second resonator cylinder 152 having a smaller diameter. For the sake of pretuning, the coupling between the HEHx mode and the HEEx mode as well as between the HEHy mode and the HEEy mode, different diameters and heights may be used for the cylindrical dielectric resonator sections. Thus, this may be used as an alternative for the displacement of the resonator along the z-axis.

Figure 30:
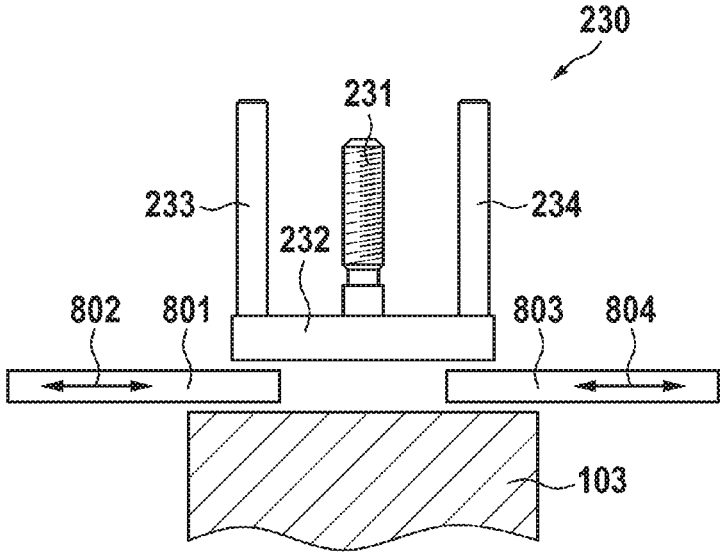
FIG. 30 shows a combination of tuning elements.

FIG. 30 shows a combination of tuning elements. A bar 232 is combined with coupling elements 801, 803 which may be moved radially into directions 802, 804. These directions preferably lie in line with the orientation of the bar. The coupling elements 801, 803 may have a cylindrical shape with circular or rectangular cross section.

Figure 31:
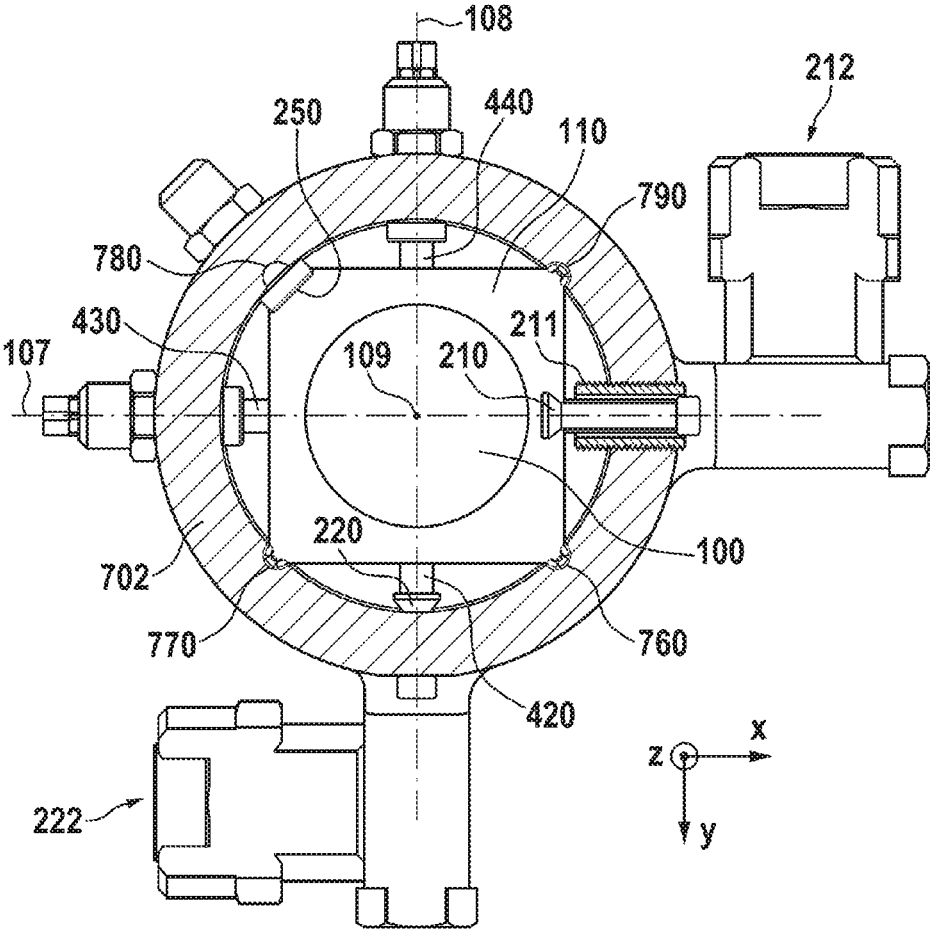
FIG. 31 shows a modified external coupling element.

FIG. 31 shows an adjustable outer conductor 211 of the external coupling element 210. This outer conductor 211 is attached and/or connected to the housing 702 and preferably is cylindrically shaped. An outer thread may further be provided. By moving this outer conductor in or out, the reference plane may be altered and parasitic couplings between HEHx and HEEy, or HEHy and HEEx may be nullified respectively. Combining this effect with the option to tune the coupling between HEEx and HEEy with the help of the tuning rods or the cuboid tuning elements as mentioned above, it is possible to tune a filter without the need of first coupling elements 230, 250 (shown, for example, in FIG. 9). This embodiment may also be applied to any other external coupling element.

It will be appreciated to those skilled in the art having the benefit of this disclosure that this invention is believed to provide a microwave or RF bandpass filter. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

100 dielectric resonator
101 dielectric resonator height
102 dielectric resonator diameter
103 outer section
104 inner section
105 first face surface
106 second face surface
107 first orthogonal plane
108 second orthogonal plane
109 dielectric resonator center axis
110 first support plate
111, 112, 113, 114 compensation plates
120 second support plate
150 stacked dielectric resonator
151 first resonator cylinder
152 second resonator cylinder
170 split dielectric resonator
171, 172, 173, 174 split resonator sections
175, 176, 177, 178 tuning elements
180 split dielectric resonator
181, 182, 183, 184 first split resonator sections
185, 186, 187, 188 second split resonator sections
210 first external coupling element
212 first external connector
220 second external coupling element
221 second external inner conductor
222 second external connector
230 bottom first internal coupling element
231 bottom first internal coupling element adjustment screw
232 bar
233, 234 support rods
235, 236 coupling button
237 axis of bar
238 angle between axis of bar and first orthogonal plane
240 top first internal coupling element
241 top first internal coupling element adjustment screw
242 bar
243, 244 support rods
245, 246 coupling buttons
250 second internal coupling element
251 second internal coupling element adjustment screw
252 second internal coupling element locking nut
260, 270, 280, 290 third internal coupling elements
410 first bottom tuning rod
420 second bottom tuning rod
430 third bottom tuning rod
432 third bottom tuning rod locking nut
440 fourth bottom tuning rod
510 first top tuning rod
520 second top tuning rod
530 third top tuning rod
532 third top tuning rod locking nut
540 fourth top tuning rod
630 first side tuning means
632 first side tuning means locking nut
640 second side tuning means
642 second side tuning means locking nut
643 second side tuning means outer thread
645 second side tuning means locking nut
649 second side tuning means center axis
701 cover
702 housing
703 cover screws
704 screw holes
705 cavity
709 cavity center axis
711 dielectric resonator base height
712 inner height
713 inner diameter
760, 770, 780, 790 grooves
801, 803 coupling elements
802, 804 direction indicators
810, 820, 830, 840 coupling elements
811, 821, 831, 841 direction indicators
860, 870, 880, 890 spacers
901 source
902 load
911 HEHx mode
912 HEEx mode
913 HEEy mode
914 HEHy mode
921 coupling source—HEHx
922 coupling HEHx—HEHy
923 coupling HEHx—HEEy
924 coupling HEHx—HEEx
925 coupling HEEx—HEEy
926 coupling HEEx—HEHy
927 coupling HEEy—HEHy
928 coupling HEHy—load

The invention claimed is:

1. A bandpass filter configured to operate in a microwave portion of a frequency spectrum or a radiofrequency (RF) portion of the frequency spectrum, the filter comprising:

a housing made of a conductive material and defining a cylindrical cavity therein;

at least one cylindrical dielectric resonator having an outer contour defined by a pair of parallel face surfaces, wherein each face surface has at least two symmetry axes, the at least one cylindrical dielectric resonator having a center axis, wherein the at least one cylindrical dielectric resonator is held by holding means within the cylindrical cavity, and at least one first internal coupling element configured in a plane orthogonal to the center axis and crossing the center axis to couple energy between an $HEE_X$ mode and an $HEE_Y$ mode of said at least one cylindrical dielectric resonator, the at least one first internal coupling element comprising an electrically conductive bar or a dielectric bar, wherein the at least one first internal coupling element is configured to be moveable parallel to the center axis.

2. The bandpass filter according to claim 1, further comprising at least one tuning member that includes a tuning rod that is fastened to the housing and protruding into the cylindrical cavity between ends of the first internal coupling element and the dielectric resonator, said at least one tuning member including a dielectric material.

3. The bandpass filter according to claim 2, wherein the tuning rod has a circular cross section.

4. The bandpass filter according to claim 1, comprising:

at least one tuning rod that contains a dielectric material, the at least one tuning rod being fastened to the housing and protruding into the cylindrical cavity at a location outside of the at least one cylindrical dielectric resonator and in a direction towards the center axis at a location above or under at least one of the pair of parallel face surfaces, wherein a projection of an end of the at least one tuning rod onto one of the face surfaces along an axis that is parallel to the center axis is contained within one of the face surfaces.

5. The bandpass filter according to claim 1, wherein the at least one cylindrical dielectric resonator has the pair of parallel face surfaces defined by a pair of parallel circular face surfaces.

6. The bandpass filter according to claim 1, comprising at least two tuning rods that are evenly arranged in a plane orthogonal to the center axis.

7. The bandpass filter according to claim 1, further comprising one, two or four tuning rods arranged in a first plane that is located above and parallel to a first face surface of said face surfaces and comprising additional one, two or four tuning rods that are arranged in a second plane that is located below and parallel to a second face surface of said face surfaces.

8. The bandpass filter according to claim 1, wherein the at least one dielectric resonator comprises two cylindrical outer sections that are separated from each other.

9. The bandpass filter according to claim 8, wherein the at least one dielectric resonator further includes at least one cylindrical inner section between the two cylindrical outer sections.

10. The bandpass filter according to claim 1, wherein the holding means comprises at least one support plate of a dielectric material, said holding means being arranged parallel to at least one of the face surfaces from said pair of parallel face surfaces, said holding means supported by the housing.

11. The bandpass filter according to claim 1, wherein the at least one cylindrical dielectric resonator comprises a ceramic material.

12. The bandpass filter according to claim 1, wherein a ratio of a diameter of the at least one cylindrical dielectric resonator to a height of the at least one cylindrical dielectric resonator is in a first range from 0.9 to 3.1 or in a second range from 1.7 to 2.3.

13. The bandpass filter according to claim 1, further comprising at least one external coupling element that extends from the housing transversely with respect to the center axis.

14. The bandpass filter according to claim 1, wherein the at least one first internal coupling element is in at least one of the following positions: (i) above the at least one cylindrical dielectric resonator and (ii) below the at least one cylindrical resonator.

15. The bandpass filter according to claim 1, further comprising at least one of a plurality of conductive third internal coupling elements protruding into the cylindrical cavity and arranged within a plane orthogonal to the center axis above or under the at least one cylindrical dielectric resonator.

16. The bandpass filter according to claim 1, wherein the at least one dielectric resonator is displaced axially with respect to a center of the cylindrical cavity to thereby effectuate coupling of energy from an HEHx mode and an HEHy mode to the HEEx mode and the HEEy mode, respectively.

17. The bandpass filter according to claim 1, wherein at least one of the following conditions is satisfied:

i) a first dielectric constant of a first dielectric material is lower that a second dielectric constant of the second dielectric material, the second dielectric material being a material of the at least one cylindrical dielectric resonator, the first dielectric material being a material of the holding means, and ii) a thickness of the first dielectric material is smaller than a height of the at least one cylindrical dielectric resonator.

18. The bandpass filter according to claim 1, wherein the at least one first internal coupling element is comprised by the conductive bar with coupling buttons at opposing ends of the conductive bar.

* * * * *